US006297476B1

(12) United States Patent
Kashino et al.

(10) Patent No.: US 6,297,476 B1
(45) Date of Patent: Oct. 2, 2001

(54) THERMALLY DEVELOPING APPARATUS

(75) Inventors: Teruo Kashino; Akira Taguchi; Hirofumi Okabe; Yasuaki Tamakoshi; Masaya Shimoji, all of Sayama (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/520,375

(22) Filed: Mar. 6, 2000

(30) Foreign Application Priority Data

Mar. 11, 1999 (JP) ..... 11-064930
Oct. 22, 1999 (JP) ..... 11-300749

(51) Int. Cl.[7] ..... G03G 15/20; G03L 5/16; G03D 13/00

(52) U.S. Cl. ..... 219/216; 399/69; 399/334; 430/350; 430/353

(58) Field of Search ..... 219/216, 470, 219/471; 399/69, 279, 286, 334; 480/350, 351, 353

(56) References Cited

U.S. PATENT DOCUMENTS 3,624,353 * 11/1971 Bjorklund ..... 219/470
4,745,431 * 5/1988 Kogure et al. ..... 399/69
5,204,723 * 4/1993 Hanada et al. ..... 219/216
5,241,159 * 8/1993 Chatteriee et al. ..... 219/470
5,402,211 * 3/1995 Yoshikawa ..... 219/216
5,580,478 * 12/1996 Tanamachi et al. ..... 219/216
5,640,231 * 6/1997 Mitsui et al. ..... 219/216
5,826,152 * 10/1998 Suzuki et al. ..... 399/334
5,869,806 * 2/1999 Struble et al. ..... 219/216
5,961,864 * 10/1999 Nakajima et al. ..... 219/216
6,007,971 * 12/1999 Star et al. ..... 430/350
6,011,939 * 1/2000 Martin ..... 399/69
6,091,059 * 7/2000 Sato et al. ..... 219/469

FOREIGN PATENT DOCUMENTS 6-222694 * 8/1994 (JP) .

* cited by examiner

*Primary Examiner*—Joseph Pelham
(74) *Attorney, Agent, or Firm*—Bierman, Muserlian and Lucas

(57) ABSTRACT

A thermally developing apparatus is provided with a heating device to heat a thermally developable material; a supplier for supplying the thermally developable material in a predetermined supplying direction to the heating device; the heating device having plural regions aligned in a direction substantially perpendicular to the supplying direction of the thermally developable material by the supplier; plural heaters each provided separately to one of the plural regions and to heat a corresponding one of the plural regions of the heating device; and a controller to control heat generation of the plural heaters, the controller controlling at least one of the plural heaters in accordance with a size of the thermally developable material which is a length substantially perpendicular to the supplying direction.

32 Claims, 11 Drawing Sheets

THERMALLY DEVELOPING APPARATUS

BACKGROUND OF THE INVENTION

This invention relates to a thermally developing apparatus, and in particular, to a thermally developing apparatus wherein image formation is carried out by holding a thermally developable material on the outer circumferential surface of a heated drum.

A thermally developing apparatus has been developed which is capable of forming a visible image from an image which has been formed as a latent image by continuously supplying sheet-shaped thermally developable materials to the outer circumferential surface of a heated drum to cause a thermal reaction to occur in these thermally developable materials (refer to TOKUHYOHEI 10-500497 and TOKUHYOHEI 10-500506). According to these thermally developing apparatus, a sheet-shaped thermally developable material is supplied to the outer circumferential surface of a drum rotating at a constant rotational speed, and after the drum has rotated for a predetermined rotary angle with the thermally developable material being held, the thermally developable material is detached from the outer circumferential surface of the drum, while a new thermally developable material is simultaneously supplied to the outer circumferential surface of the drum; hence, it is possible to heat sheet-shaped thermally developable materials efficiently.

However, it has been proved that, in a thermally developing apparatus which heats a thermally developable material as it is held by a heating member controlled at a predetermined thermal development temperature (for example, the apparatus disclosed in TOKUHYOHEI 10-500497), when a thermally developable material having a different size from a preceding thermally developable material is thermally developed immediately after said preceding one is thermally developed, sometimes unevenness of density appears in the succeeding thermally developable material.

In respect of this, in the description of TOKUHYOHEI 10-500506, a thermally developing apparatus wherein temperature control is made for each of the regions, that is, the central portion of the drum and its both side regions is disclosed. However, in this prior art, the purpose of dividing the region for temperature control is to eliminate the temperature difference being produced in the central portion and its both sides owing to the cooling from both sides of the drum, and no disclosure or even no suggestion is done concerning the density unevenness which may appear in the case where thermally developable materials having different sizes from one another are supplied.

SUMMARY OF THE INVENTION

It is an object of this invention to provide a thermally developing apparatus capable of suppressing the generation of such unevenness of density and stabilizing the density of image.

The above object can be attained by the following structures.

(1-1) A thermally developing apparatus, comprises:

a heating member to heat a thermally developable material;

supplying means for supplying the thermally developable material in a predetermined supplying direction to the heating member;

the heating member comprising plural regions aligned in a direction substantially perpendicular to the supplying direction of the thermally developable material by the supplying means;

plural heaters each provided separately to one of the plural regions and to heat a corresponding one of the plural regions of the heating member; and a controller to control heat generation of the plural heaters, the controller controlling at least one of the plural heaters in accordance with a size of the thermally developable material which is a length substantially perpendicular to the supplying direction.

(1-2) In the thermally developing apparatus of (1-1), the controller controls at least one of the plural heaters in such a manner that a control target for at least one of the plural regions is made different from a control target for the other regions in accordance with the size of the thermally developable material.

(1-3) In the thermally developing apparatus of (1-1), the thermally developing apparatus further comprises a size sensor to detect the length of the thermally developable material substantially perpendicular to the supplying direction as the size of the thermally developable material, wherein the controller controls heat generation of at least one of the plural heaters in accordance with a detection result of the size sensor.

(1-4) In the thermally developing apparatus of (1-1), a control target for at least one of the plural heaters at the timing that the supplying means supplies the thermally developable material is made different from that at the other timing.

(1-5) In the thermally developing apparatus of (1-4), a controller controls heat generation of the plural heaters in such a manner that a control target for at least one of heaters provided to regions to which the thermally developable material is not supplied when the supplying means supplies the thermally developable material to the heating member is made lower than a control target for the heater when the supplying means does not supply the thermally developable material to the heating member.

(1-6) In the thermally developing apparatus of (1-5), a controller controls heat generation of the plural heaters in such a manner that a control target for at least one of heaters provided to regions to which the thermally developable material is not supplied when the supplying means supplies the thermally developable material to the heating member is made different in accordance with the size of the thermally developable material.

(1-7) In the thermally developing apparatus of (1-4), when the supplying means supplies plural types of thermally developable materials different in length substantially perpendicular to the supplying direction, a control target for at least one of heaters provided to regions to which all of the plural types of thermally developable materials are supplied is made higher at the timing to supply a thermally developable material than that at the other timing.

(1-8) In the thermally developing apparatus of (1-7), a control target for at least one of heaters provided to regions to which all of the plural types of thermally developable materials are supplied is made different in accordance with the size of the thermally developable material.

(1-9) In the thermally developing apparatus of (1-4), a range between a control target at the timing to supply the thermally developable material and a control target at the other timing is smoothed by a ramp processing.

(1-10) In the thermally developing apparatus of (1-4), the heating member comprises a metallic supporting member and an elastic layer located at a heating surface side of the metallic supporting member, and the heater is a plane heater provided in close contact with a surface at a side opposite to the heating surface side of metallic supporting member.

(1-11) In the thermally developing apparatus of (1-1), the thermally developing apparatus is adapted to develop plural types of thermally developable materials different in length substantially perpendicular to the supplying direction, and wherein the plural regions to which a thermally developable material having the maximum size among the plural types of thermally developable materials is supplied is divided into three regions of a central region and side regions in the direction substantially perpendicular to the supplying direction and the thermally developing apparatus further comprises temperature sensors provided the side regions respectively so as to be in close contact with the heating member so that the temperature sensors detect the temperature of the heating member.

(1-12) The thermally developing apparatus of (1-11), each of the side regions of the heating member is provided a groove and each of the temperature sensors is provided in the groove.

(1-13) In the thermally developing apparatus of (1-12), the grooves are located both ends of the heating member in the direction substantially perpendicular to the supplying direction.

(1-14) In the thermally developing apparatus of (1-11), the controller conducts temperature control by using a value corresponding to a time integral value of the temperature detected by the temperature detecting means.

(1-15) In the thermally developing apparatus of (1-11), the controller conducts temperature control by using a value corresponding to a time differential value of the temperature detected by the temperature detecting means.

(1-16) In the thermally developing apparatus of (1-1), the plural heaters are operated ON-mode or OFF-mode and the controller controls the heater by a duty ratio of the ON-mode to the OFF-mode.

(1-17) In the thermally developing apparatus of (1-1), the thermally developing means comprises a thermally developing section to thermally develop the thermally developable material, the thermally developing section has an inner section covered with a heat insulating member and the heater and the heating member are provided in the inner section.

(1-18) In the thermally developing apparatus of (1-17), the controller controls heat generation of the plural heaters in such a manner that a ratio of a sum of amounts of heat which the plural heaters give a single sheet of a thermally developable material when the single sheet of a thermally developable material is thermally developed to a sum of the maximum amounts of the plural heaters when the single sheet of a thermally developable material is thermally developed is 0.04 to 0.75.

(1-19) In the thermally developing apparatus of (1-1), the heating member is a rotating member which heats the thermally developable material while rotating on a condition that the thermally developable material is in close contact with a outer circumferential surface of the rotating member, the rotating member is divided so as to have the plural regions aligned in an axial direction thereof and each of the plural regions is provided with one of the plural heaters.

(1-20) In the thermally developing apparatus of (1-1), the thermally developing apparatus further comprises:

a rotatable roller urged onto the heating member.

(1-21) In the thermally developing apparatus of (1-1), an elastic layer having a thickness of 0.1 mm or more is provided on a surface of the heating member.

(1-22) In the thermally developing apparatus of (1-21), a ratio of a thermal conductivity of the elastic layer to the thickness of the elastic layer is 0.15 (W/m/°K/mm) or more, and the heating member comprises a metallic supporting member to support directly or indirectly the elastic member.

(1-23) In the thermally developing apparatus of (1-21), the elastic layer has the thickness of 2 mm or less and the thermal conductivity of 0.3 W/m/°K or more.

(1-24) A thermally developing apparatus, comprises:

a heating member to heat a thermally developable material;

supplying means for supplying the thermally developable material in a predetermined supplying direction to the heating member;

the heating member comprising plural regions aligned in a direction substantially perpendicular to the supplying direction of the thermally developable material by the supplying means;

plural heaters each provided separately to one of the plural regions and to heat a corresponding one of the plural regions of the heating member; and a controller to control heat generation of the plural heaters, the controller controls the plural heaters in such a manner that a control target for a heater at the time that the supplying means supplies the thermally developable material to the heating member is made different from that for a heater at the other time in accordance with a size of the thermally developable material which is a length substantially perpendicular to the supplying direction.

(1-25) In the thermally developing apparatus of (1-24), the thermally developing apparatus further comprises:

a size sensor to detect the length of the thermally developable material substantially perpendicular to the supplying direction as the size of the thermally developable material, wherein the controller controls heat generation of at least one of the plural heaters in accordance with a detection result of the size sensor.

The inventor has discovered the following as the result of a diligent study on the cause of generation of the above-described density unevenness, to achieve this invention.

That is, immediately after a thermally developable material is thermally developed, temperature difference is produced between the region where the thermally developable material was held and the regions other than that, because heat has been taken from the region where the preceding thermally developable material has been held and heat has not been taken so much from the other regions, and owing to this, if a thermally developable material having a larger size than the preceding one is thermally developed successively, sometimes unevenness of density appears. Further, if thermally developable materials having the same size are continuously developed thermally, the above-described temperature difference in the width direction with respect to transporting increases more and more to produce unevenness of density remarkably.

Accordingly, the above object may be attained by the following preferable structures.

(2-1) The thermally developing apparatus of this invention is a thermally developing apparatus comprising a heating member for heating a thermally developable material, heaters provided separately for each of regions formed by dividing said heating member in the width direction with respect to transporting (the direction substantially perpendicular to the transporting direction of said thermally developable material, hereinafter referred to as "transport-width direction" for simplicity's sake), and temperature control means for controlling the temperature of said heating member by said heaters, and heating to thermally develop a thermally developable material by said heaters in a condition that said thermally developable material is in substantially close contact with the surface of said heating member, wherein a plurality of thermally developable materials having different sizes in the transport-width direction can be thermally developed, and at least one of said plural heaters is controlled in accordance with the size in the transport-width direction of said thermally developable materials at the time of thermal development of said thermally developable materials.

According to this, a plurality of thermally developable materials having different sizes in the transport-width direction can be thermally developed, and at least one of said plural heaters is controlled in accordance with the size in the transport-width direction of said thermally developable materials at the time of thermal development of said thermally developable materials; therefore, when thermally developable materials having different sizes in the transport-width direction are thermally developed, the temperature difference between the region where thermally developable materials are held and the region other than that can be suppressed, to prevent the generation of unevenness of density.

(2-2) The thermally developing apparatus of this invention is a thermally developing apparatus comprising a heating member for heating a thermally developable material, plural heaters provided separately for each of regions formed by dividing said heating member in the transport-width direction (the direction substantially perpendicular to the transporting direction of said thermally developable material), and temperature control means for controlling the temperature of said heating member by said heaters, and heating to thermally develop a thermally developable material by said heaters in a condition that said thermally developable material is in substantially close contact with the surface of said heating member, wherein the thermally developing apparatus can thermally develop a plurality of thermally developable materials having different sizes in the transport-width direction and comprises size detecting means for detecting the size of a thermally developable material in the transport-width direction, and at least one of the plural heaters is controlled in accordance with the size of the thermally developable material in the transport-width direction when the thermally developable material is thermally developed.

According to this, a plurality of thermally developable materials having different sizes in the transport-width direction can be thermally developed, and at least one of said plural heaters is controlled in accordance with the size in the transport-width direction of said thermally developable materials detected by said size detecting means for detecting the size in the transport-width direction at the time of thermal development of said thermally developable materials; therefore, when thermally developable materials having different sizes in the transport-width direction are thermally developed, the temperature difference between the region where thermally developable materials are held and the region other than that can be suppressed, to prevent the generation of density unevenness.

(2-3) Further, by making the target value of control for at least one of the aforesaid plurality of heaters different between the timing in which a thermally developable material is being supplied and the timing other than that in a thermally developing apparatus set forth in the above-described paragraph (2-1) or (2-2), for example, by increasing the amount of heating by the heater corresponding to the region which a thermally developable material passes in the timing while said thermally developable material is supplied, and decreasing it in the timing other than that, or by decreasing the amount of heating by the heater corresponding to the region which a thermally developable material does not pass in the timing while said thermally developable material is supplied, and increasing it in the timing other than that, the temperature of the outer circumferential surface of the drum can be made uniform in the width direction, by which unevenness of density can be suppressed.

Further, it is desirable that the above-described timing in which a thermally developable material is supplied is let to be the time period substantially from the time when the leading edge of a thermally developable material first comes in contact with the aforesaid heating member to the time when the trailing edge of said thermally developable material first comes in contact with said heating member, because it fits the actual variation of heat quantity which is taken by thermally developable materials with the passage of time; however, it is not limited to this, and may be the time period from the time when the leading edge of a thermally developable material first comes in contact with said heating member and to the time when the thermally developable material is completely in close contact with said heating member, or it may be the time period from the time when the leading edge of a thermally developable material first comes in contact with said heating member to the time when the trailing edge of said thermally developable material detaches from said heating member.

(2-4) Further, by making lower the target value of control for at least one of the aforesaid heaters corresponding to the region which a thermally developable material does not pass, in the timing in which a thermally developable material is supplied than in the timing other than that in a thermally developing apparatus set forth in the above-described paragraph (2-3), in the timing while a thermally developable material is supplied, the amount of heating by the heater corresponding to the region which the thermally developable material does not pass decreases; therefore, in the region which the thermally developable material does not pass, temperature decreases in the same way as the region from which heat is taken by the thermally developable material (the region which the thermally developable material pass), and the temperature can be made uniform as much as possible in the transport-width direction of the thermally developable material, by which unevenness of density can be suppressed.

(2-5) Further, by making the target value of control for the heater corresponding to the region which a thermally developable material does not pass in the timing in which a thermally developable material is supplied different in accordance with the aforesaid size in the transport-width direction in a thermally developing apparatus set forth in the above-described paragraph (2-4), for example, by making the target value of control in the timing while a thermally developable material is supplied lower for a smaller size in the transport-width direction than for a larger size to decrease the amount of heating by the heater, the temperature on the outer circumferential surface of the drum can be made uniform as much as possible in the transport-width direction regardless of the size in the transport-width direction, by which unevenness of density can be suppressed.

(2-6) Further, by making higher the target value of control for at least one of the aforesaid heaters corresponding to an region which all the thermally developable materials having the aforesaid plurality of sizes in the transport-width direction pass, in the timing while a thermally developable material is supplied than in the timing other than that in a thermally developing apparatus set forth in any one of the above-described paragraphs (2-3) to (2-5), in the timing while a thermally developable material is supplied, in the region which the thermally developable material passes, through raising the amount of heating by the heater in order to make up for the heat taken by the thermally developable material, the temperature on the outer circumferential surface of the drum can be made uniform as much as possible in the transport-width direction, by which unevenness of density can be suppressed.

(2-7) Further, by making the target value of control for the heater corresponding to the region of the heating member in the transport-width direction, which all of thermally developable materials having the aforesaid plurality of sizes in the transport-width direction pass, in the timing while a thermally developable material is supplied, different in accordance with said size in the transport-width direction in a thermally developing apparatus set forth in the above-described paragraph (2-6), for example, by raising higher the target value of control in the timing while a thermally developable material is supplied, when the size in the transport-width direction is large than when it is small, to increase the amount of heating by the heater, the temperature on the outer circumferential surface of the drum can be made uniform as much as possible in the transport-width direction regardless of the size in the transport-width direction being large or small, by which unevenness of density can be suppressed.

(2-8) The thermally developing apparatus of this invention is a thermally developing apparatus comprising a heating member for heating a thermally developable material, heaters provided separately for each of regions formed by dividing said heating member in the transport-width direction, and temperature control means for controlling the temperature of said heating member by said heaters, and heating to thermally develop a thermally developable material by said heaters in a condition that said thermally developable material is in substantially close contact with the surface of said heating member, wherein a plurality of thermally developable materials having different sizes in the transport-width direction can be thermally developed, and the heater having different target values of control between the timing while a thermally developable material is supplied and the timing other than that is changed in accordance with the aforesaid size in the transport-width direction of thermally developable materials. According to this, a plurality of thermally developable materials having different sizes in the transport-width direction can be thermally developed, and as described later with reference to FIG. 11, by changing the heater having different target values of control between the timing while a thermally developable material is supplied and the timing other than that in accordance with the size in the transport-width direction of thermally developable materials, the temperature of the heating member can be made uniform as much as possible in the transport-width direction of thermally developable materials, through increasing or decreasing the amount of heating by the heater corresponding to the suitable region in accordance with the passing region which varies depending on the size in the transport-width direction, in order to make up for the heat taken by a thermally developable material or to decrease the heat quantity in other regions by the same amount as that taken by the thermally developable material, by which unevenness of density can be suppressed.

(2-9) The thermally developing apparatus of this invention is a thermally developing apparatus comprising a heating member for heating a thermally developable material, heaters provided separately for each of regions formed by dividing said heating member in the transport-width direction, and temperature control means for controlling the temperature of said heating member by said heaters, and heating to thermally develop a thermally developable material by said heaters in a condition that said thermally developable material is in a substantially close contact with the surface of said heating member, said thermally developing apparatus further comprising size detecting means for detecting the size in the transport-width direction of a thermally developable material, wherein a plurality of thermally developable materials having different sizes in the transport-width direction can be thermally developed, and the heater having a different target values of control between the timing while a thermally developable material is supplied and the timing other than that is changed in accordance with the size in the transport-width direction of thermally developable materials detected by said size detecting means. According to this, a plurality of thermally developable materials having different sizes in the transport-width direction can be thermally developed, and as described later with reference to FIG. 11, by changing the heater having different target values of control between the timing while a thermally developable material is supplied and the timing other than that in accordance with the detected size in the transport-width direction of thermally developable materials, the temperature of the heating member can be made uniform as much as possible in the transport-width direction of thermally developable materials, through increasing or decreasing the amount of heating by the heater corresponding to the suitable region, in accordance with the passing region which varies depending on the size in the transport-width direction of thermally developable materials, in order to make up for the heat taken by a thermally developable material or to decrease the heat quantity in other regions by the same amount as that taken by the thermally developable material, by which unevenness of density can be suppressed.

(2-10) Further, by making smooth the intermediate part between the target value of control in the aforesaid timing while a thermally developable material is supplied and the target value of control in the timing other than that by ramp processing in a thermally developing apparatus set forth in any one of the above-described paragraphs (2-3) to (2-9), a sudden change of the temperature can be suppressed, by which unevenness of density can be prevented. In the above, ramp processing means a processing for making a target of control not vary suddenly but vary gradually and continuously.

(2-11) Further, by making the aforesaid heating member be composed of a supporting member made of a metal and an elastic layer on its heating surface side and the aforesaid heaters be plane-shaped heaters provided in close contact with the opposite surface to the heating surface of said supporting member in a thermally developing apparatus set forth in any one of the above-described paragraphs (2-1) to (2-10), a thermally developable material which is supplied to the heating member and in close contact with it owing to the elastic layer can be heated efficiently and satisfactorily, through the supporting member made of a metal having an excellent thermal conductivity.

(2-12) Further, it is desirable that a thermally developing apparatus set forth in any one of the above-described paragraphs (2-1) to (2-11) is provided with at least one temperature sensor for detecting the temperature of the aforesaid heating member in each of the left and right portions with respect to the transport-width direction outside the central portion corresponding to one third of the total range in the transport-width direction which heats a thermally developable material having the maximum size in the transport-width direction, because the temperature of the heating member in each of the left and right portions with respect to the transport-width direction outside the central portion of one third of the total range can be correctly measured, to suppress the non-uniformity of the temperature in the transport-width direction and the generation of unevenness of density. Besides, for the mode of the temperature sensor being in close contact with the heating member, not only the mode in which the sensor is simply in close contact with the surface of the heating member, but also the mode in which, for example, the temperature sensor is disposed in a position in a concave portion or in a slot which is provided in the heating member may be employed.

(2-13) It is desirable that, in a thermally developing apparatus set forth in any one of the above-described paragraphs (2-1) to (2-12), there is at least one clearance between the neighboring heaters in which a temperature sensor for detecting the temperature of the aforesaid heating member is provided in close contact with said heating member, not in contact with said heaters, in each of the left and right portions with respect to the transport-width direction outside the central portion corresponding to one third of the total range in the transport-width direction which heats a thermally developable material having the maximum size in the transport-width direction, because the measurement can be made without being subject to the influence of the temperatures of the heaters, which are often different from the temperature of the heating member, and the temperature of the heating member can be measured more correctly, to suppress the non-uniformity of the temperature in the transport-width direction and the generation of unevenness of density.

(2-14) Further, It is desirable that, in a thermally developing apparatus set forth in the above-described paragraph (2-3), there is at least one central heater provided between the clearances between the neighboring heaters in which a temperature sensor for detecting the temperature of the aforesaid heating member is provided in close contact with said heating member, not in contact with said heaters, said clearances being at least one provided in each of the left and right portions with respect to the transport-width direction outside the central portion corresponding to one third of the total range in the transport-width direction which heats a thermally developable material having the maximum size in the transport-width direction, and at least one side heater is provided in each of the outside portions of said clearances with respect to the transport-width direction, because the non-uniformity of the temperature in the transport-width direction can be suppressed.

(2-15) Further, according to a thermally developing apparatus set forth in the above-described paragraph (2-2) or (2-9), wherein the aforesaid temperature control means carries out a temperature control using a value equivalent to the time-integral value of the temperature detected by the aforesaid temperature sensor, the difference between the average temperature and the temperature of the target of control owing to the surface of the heating member and the position of the temperature sensor being apart from each other, which varies depending on the size of thermally developable materials, can be reduced and a thermal development having desired characteristics can be carried out. In the above, the average temperature means the average value of the temperature detected by an arbitrary temperature sensor in a predetermined time.

Besides, a value equivalent to the time-integral value may be not only a time-integral value but also an accumulated value of the latest detected temperature or an average value of the latest detected temperature.

(2-16) Further, according to a thermally developing apparatus set forth in any one of the above-described paragraphs (2-2), (2-9), and (2-15), wherein the aforesaid temperature control means carries out a temperature control using a value equivalent to a time-derivative value of the temperature detected by the aforesaid temperature sensor, overshoots and undershoots against the target of control can be reduced and the fluctuation of temperature with the passage of time owing to the overshoots and undershoots can be suppressed, to make it possible to prevent unevenness of density.

Besides, a value equivalent to time-derivative value may be not only a time-derivative value but also a differential value between the former and present detected values of the temperature, or the difference between the average value of the latest detected temperature values and the average value of those before the latest, or the like.

(2-17) Further, it is desirable that, in a thermally developing apparatus set forth in any one of the above-described paragraphs (2-1) to (2-16), the aforesaid temperature control means controls the aforesaid heaters by the method of controlling the ON/OFF duty ratio; thus, a control with a good efficiency can be accomplished by a simple structure.

(2-18) Further, it is desirable that, in a thermally developing apparatus set forth in any one of the above-described paragraphs (2-1) to (2-17), the aforesaid heating member and the aforesaid heaters are provided in the thermal development section which is substantially covered with a heat insulating member and thermally develops thermally developable materials by heating, because the heat dissipation from said heating member and said heater to the outside of said thermal development section can be suppressed, and the temperature is stabilized.

(2-19) Further, by making the ratio of the heat quantity required for thermally developing a sheet of thermally developable material to the maximum amount of heat generation, which can be generated during the developing period by all the heaters provided in said thermal development section, be a value from 0.04 to 0.75, in a thermally developing apparatus set forth in the above-described paragraph (2-18), the non-uniformity of the temperature is suppressed by a simple control and a stable gradation reproduction having unevenness of density suppressed can be made, because the duty ratio does not become too small, and the heaters have a sufficient margin.

(2-20) Further, by making the aforesaid heating member be a rotary member which carries out heating a thermally developable material held substantially in close contact with its outer circumferential surface while it is rotating, in a thermally developing apparatus set forth in any one of the above-described paragraphs (2-1) to (2-19), thermal development with a high efficiency can be accomplished, because thermally developable materials can be supplied continuously.

(2-21) Further, by providing the aforesaid heaters respectively in the plural regions formed by dividing the aforesaid rotary member in the direction of the axis of rotation in a thermally developing apparatus set forth in the above-described paragraph (2-20), the unevenness of density of the thermally developable materials can be suppressed regardless of the size, because the temperature of the aforesaid heating member can be adjusted in accordance with the thermally developable materials with a plurality of sizes having respectively different lengths in the direction of the axis of rotation of said rotary member.

(2-22) Further, it is desirable that a thermally developing apparatus set forth in any one of the above-described paragraphs (2-1) to (2-21) further comprises supplying means for supplying a sheet-shaped thermally developable material to the aforesaid heating member, and ejecting means for ejecting a thermally developable material from said heating member.

(2-23) Further, it is desirable that, in a thermally developing apparatus set forth in any one of the above-described paragraphs (2-1) to (2-22), the aforesaid heating member is one that heats the aforesaid thermally developable material for a thermal development time at a development temperature which is equal to or higher than a [the aforesaid] lowest development temperature.

(2-24) Further, according to a thermally developing apparatus set forth in any one of the above-described paragraphs (2-1) to (2-23) further comprising rotatable rollers urged to the aforesaid heating member, it is possible to transport the aforesaid thermally developable material while being in close contact with the heating member, to thermally develop it efficiently without the non-uniformity of the temperature.

(2-25) Further, according to a thermally developing apparatus set forth in any one of the above-described paragraphs (2-1) to (2-24), wherein an elastic layer of a thickness equal to or larger than 0.1 mm is included in the surface portion of the aforesaid heating member, the condition of close contact between a thermally developable material and the heating member can be improved, to reduce the portions of the thermally developable material which are not in contact with the heating member and are likely to cause non-uniformity of the temperature of the thermally developable material to occur.

(2-26) Further, according to a thermally developing apparatus set forth in the above-described paragraph (2-25), wherein the ratio of the thermal conductivity to the thickness in the aforesaid elastic layer is equal to or larger than 0.15 (W/m/°K/mm), and the aforesaid heating member comprises a supporting member made of a metal supporting said elastic layer directly or indirectly, the heat of the heating member can be easily transferred to a thermally developable material owing to the good thermal conductivity, and an image having a suitable density can be obtained.

(2-27) Further, by making the aforesaid elastic layer have a thickness equal to or larger than 2 mm and a thermal conductivity equal to or higher than 0.3 (W/m/°K) in a thermally developing apparatus set forth in the above-described paragraph (2-26), unevenness of density can be suppressed, because the close contact condition with a thermally developable material and good heat conductance to it can be kept satisfactorily.

(2-28) Further, according to a thermally developing apparatus set forth in any one of the above-described paragraphs (2-1) to (2-27), wherein the aforesaid thermally developable material comprises photosensitive silver halide particles, organic silver salt particles, and a silver ion reducing agent, and is thermally developable at a temperature equal to or higher than a lowest development temperature which is not lower than 80° C., an image having less unevenness of density can be obtained, even though the thermally developable material is likely to have unevenness of density in response to the non-uniformity of temperature raised by heating, because the layer of the organic silver salt varies remarkably depending on the temperature difference (for example, ±0.5° C.), which is different from a usual thermally developable material.

DETAILED DESCRIPTION OF THE PREFERRED EMBODIMENT

Figure 1:
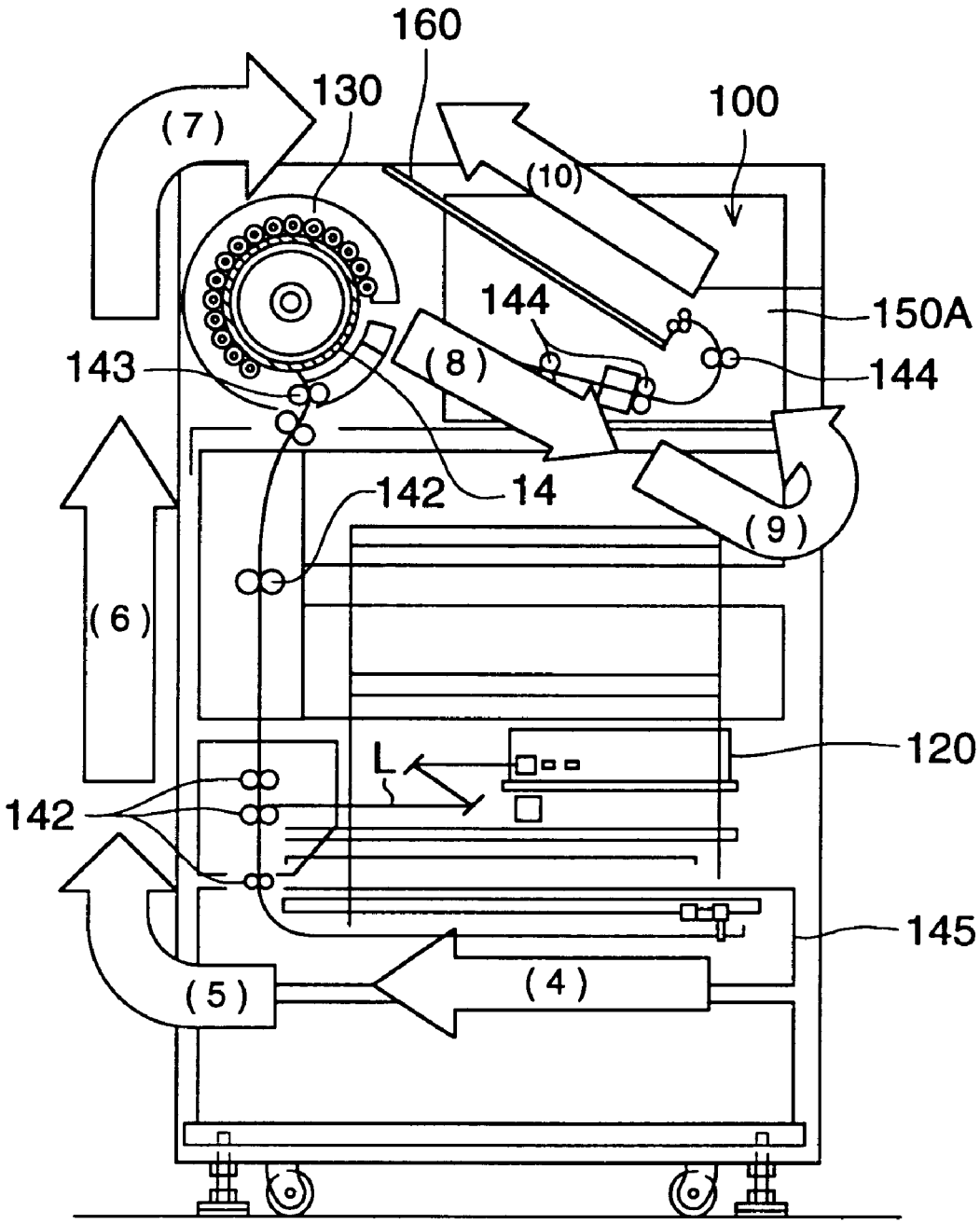
FIG. 1 is the front view of a thermally developing apparatus of an embodiment of this invention.
Figure 2:
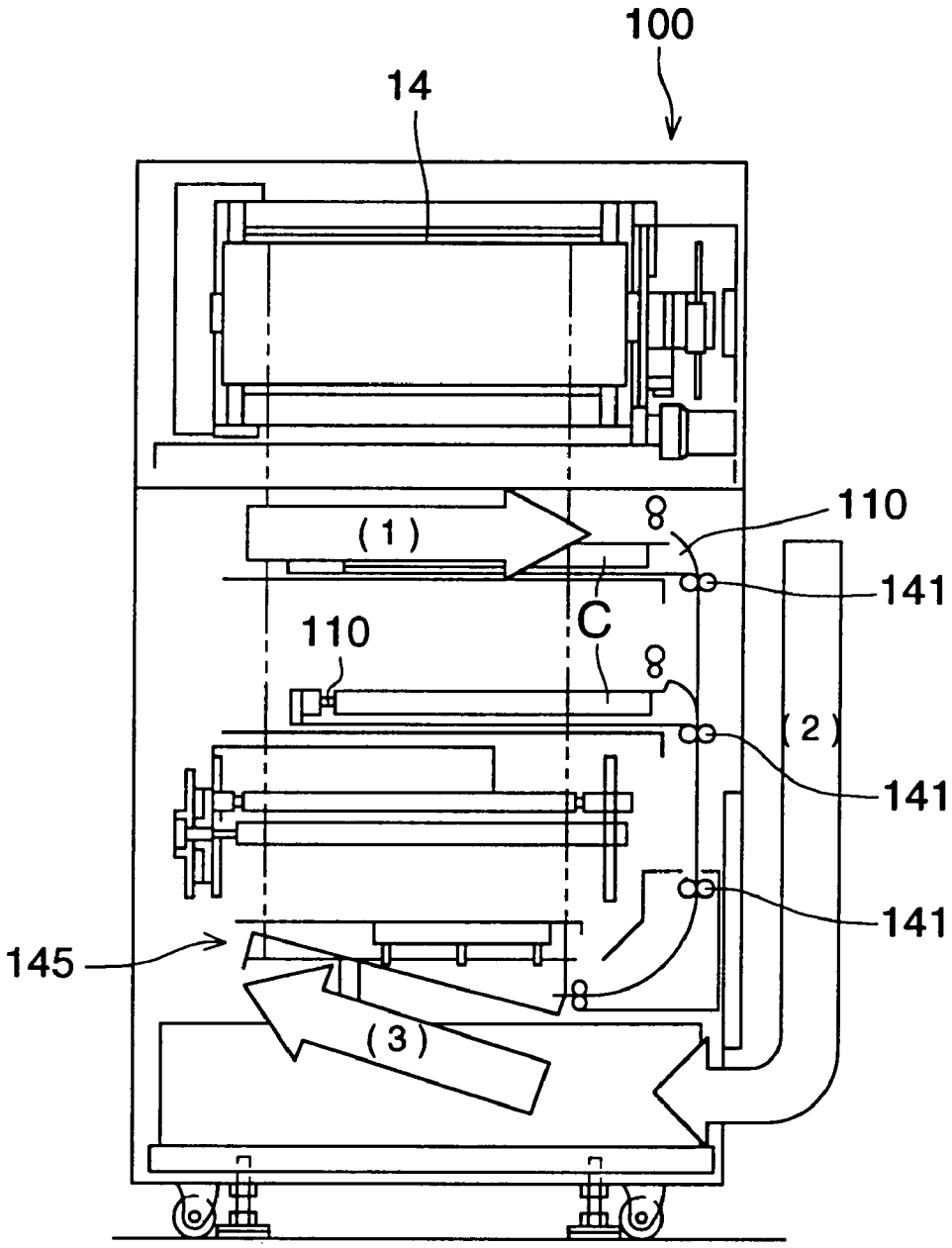
FIG. 2 is the left side view of a thermally developing apparatus of an embodiment of this invention.

In the following, an embodiment of the invention, which is an example of this invention, and an example of practice will be explained. Accordingly, it is needless to say that the meaning of the terms in the invention and the invention itself should not be construed with limitations by the description of the embodiment and the example of the invention, but it is possible that they are suitably altered or improved. FIG. 1 is the front view of a thermally developing apparatus of an embodiment of this invention, and FIG. 2 is the left side view of the above-mentioned thermally developing apparatus. The thermally developing apparatus 100 comprises the feeding section 110 which feeds the film F denoting sheet-shaped thermally developable materials shown in the example of practice one after another, the exposure section 120 at which a fed film F is exposed, and the development section 130 for developing an exposed film F. The operation of the thermally developing apparatus 100 will be explained with reference to FIG. 1 and FIG. 2.

In FIG. 2, the feeding section 110 is comprised of two stages, that is, the upper one and the lower one, and stores the film F received in the case C (refer to FIG. 3 and FIG. 4) together with the case C. In the feeding section 110, by a taking-out device not shown in the drawing, the film F is taken out from the case C, and is drawn out in the direction of the arrow mark (1) in the drawing (in the horizontal direction). The feeding section 110 as size detecting means detects the size of the film F which has been taken out on the basis of the kinds of case C in which the film F was stored, and transmits a signal as size information (including the size information of the film F in the transport-width direction at the time of being supplied to the drum 14 to be described later) to the transport device 141. Further, the transport device 141 composed of roller pairs transports the film F, which has been drawn out from the case C, in the direction shown by the arrow mark (2) in the drawing (downward), while it transmits the size information of this film F to the transport direction converting section 145.

The film F, which has been transported to the lower part of the thermally developing apparatus 100, is further transported to the transport direction converting section 145 located in the lower portion of the thermally developing apparatus 100, where it has its transport direction converted (from the direction of the arrow mark (3) in FIG. 2 to the direction of the arrow mark (4) in FIG. 1), and it is moved into the pre-exposure stage. The transport direction converting section 145 transmits the size information of this film F to the transport device 142. Further, the film F is transported from the left side of the thermally developing apparatus 100 to the direction shown by the arrow mark (5) in FIG. 1 (upward) by the transport device 142 composed of roller pairs, and during the transporting, the exposure section 120 irradiates the film F with the laser beam L having a wavelength in the infrared range of 780 to 860 nm, for example, 810 nm, while it receives the size information of this film F from the transport device 142 and transmits it to the development section 130. The development section 130 controls the heating by the heaters 32 in a mode to be described later on the basis of this size information.

Owing to the exposure to the laser beam L, a latent image is formed in the film F in a mode to be described later. After that, the film F is transported in the direction shown by the arrow mark (6) in FIG. 1 (upward), and is supplied to the drum 14 by the supplying roller pair 143. That is, the films are supplied at random timings.

Further, it may be appropriate that the supplying roller pair 143 are stopped until the next point on the circumference of the drum 14 to receive a thermally developable material reaches the predetermined rotational position, and are rotated at the timing when the next point on the circumference of the drum 14 to receive a thermally developable material has reached the predetermined rotational position. That is, it may be appropriate that, by controlling the rotation of the supplying roller pair 143, a film F is supplied to the predetermined receiving position of the drum 14.

The drum 14 is rotated together with the film F held in close contact with the outer circumference of the drum 14 in the direction shown by the arrow mark (7) in FIG. 1. In this state, the drum 14 thermally develops the film F by heating it. That is, a latent image in the film F is developed to form a visible image. After that, when the film F is revolved to the right side of the drum 14 in FIG. 1, it is detached from the drum 14 and is cooled while being transported in the direction shown by the arrow mark (8) in FIG. 1. After that, the transport device 144 transports the film F which has been detached from the drum 14 in the directions shown by the arrow marks (9) and (10) in FIG. 1, and ejects it onto the output tray 160 in order that it may be taken out from the top portion of the thermally developing apparatus 100.

Figure 3:
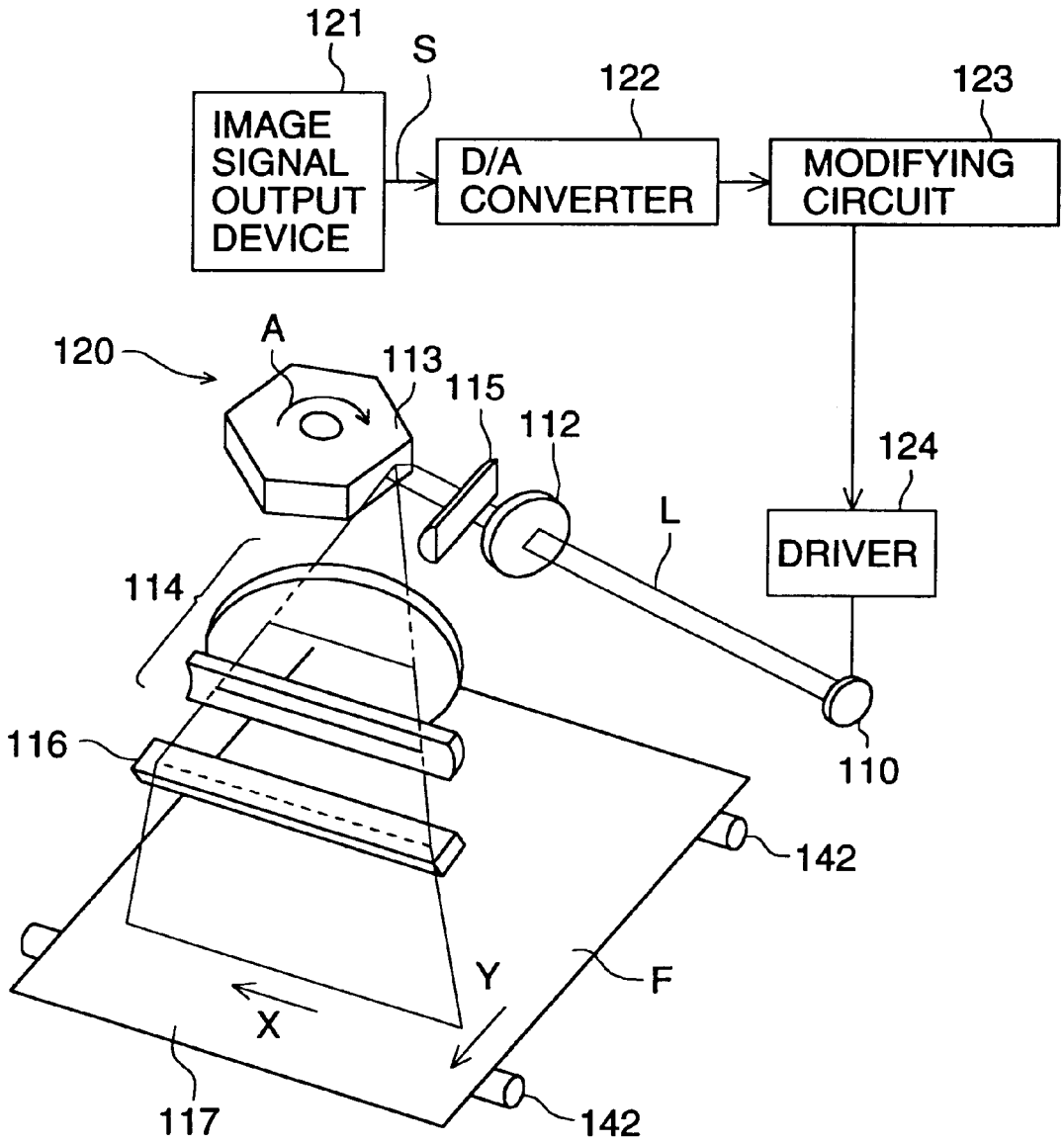
FIG. 3 is a drawing showing the outline of the structure of the exposure portion 120.

FIG. 3 is a drawing showing the outline of the structure of the exposure section 120. The exposure section 120 makes main scanning on the film F by deflecting the laser beam L which has been modified in its intensity on the basis of the image signal S by the rotary polygonal mirror 113, while it makes sub-scanning by moving the film F relatively against the laser beam L in the direction approximately perpendicular to the main scanning direction, to form a latent image in the film F using the laser beam L.

In the following, more concrete structure will be described. In FIG. 3, the image signal S denoting a digital signal outputted from the image signal outputting device 121 is converted into an analogue signal, and inputted into the modifying circuit (modulating circuit) 123. The modifying circuit 123 has a structure in which the modified laser beam L is emitted from the laser light source section 110 on the basis of the above-mentioned analogue signal by controlling the driver 124 in the laser light source section 110.

The laser beam L, which has been emitted from the laser light source section 110, is converged only in the vertical direction by the cylindrical lens 115, and comes incident on the rotary polygonal mirror 113 which is rotating in the direction shown by the arrow mark A in the drawing as a line image perpendicular to its axis of rotation. The rotary polygonal mirror 113 reflect the laser beam L to deflect it in the direction of main scanning, and the deflected laser beam L, after passing the fθ lens 114 including a cylindrical lens made up of a combination of two pieces of lens, is reflected by the mirror 116 provided on the optical path extendedly along the direction of main scanning, and makes main scanning repeatedly in the direction of the arrow mark on the surface of the film F to be scanned which is being transported (being subjected to sub-scanning) in the direction of the arrow mark Y by the transport device 142. That is, the whole surface of the film F to be scanned is subjected to the scanning by the laser beam L.

The cylindrical lens in the fθ lens 114 is one converging the incident laser beam L on the surface of the film F to be scanned only in the direction of sub-scanning, and the distance from said fθ lens 114 to said surface to be scanned is made equal to the focal length of the fθ lens 114 as a whole. In this exposure section 120, the fθ lens 114 including the cylindrical lens and the mirror 116 are arranged in this manner, and the laser beam is let to be once converged on the rotary polygonal mirror 113 only in the direction of sub-scanning; hence, even if a tilt of reflection surface and a fluctuation of the axis of rotation occur in the rotary polygonal mirror 113, the scanning position of the laser beam L does not deviate in the sub-scanning direction, and the scan lines with a constant interval can be formed. The rotary polygonal mirror 113 has an advantage that it is superior to the other light deflecting devices such as a galvanometer mirror in the stability of the scanning. As described up to now, a latent image based on the image signal S is to be formed in the film F.

Figure 4:
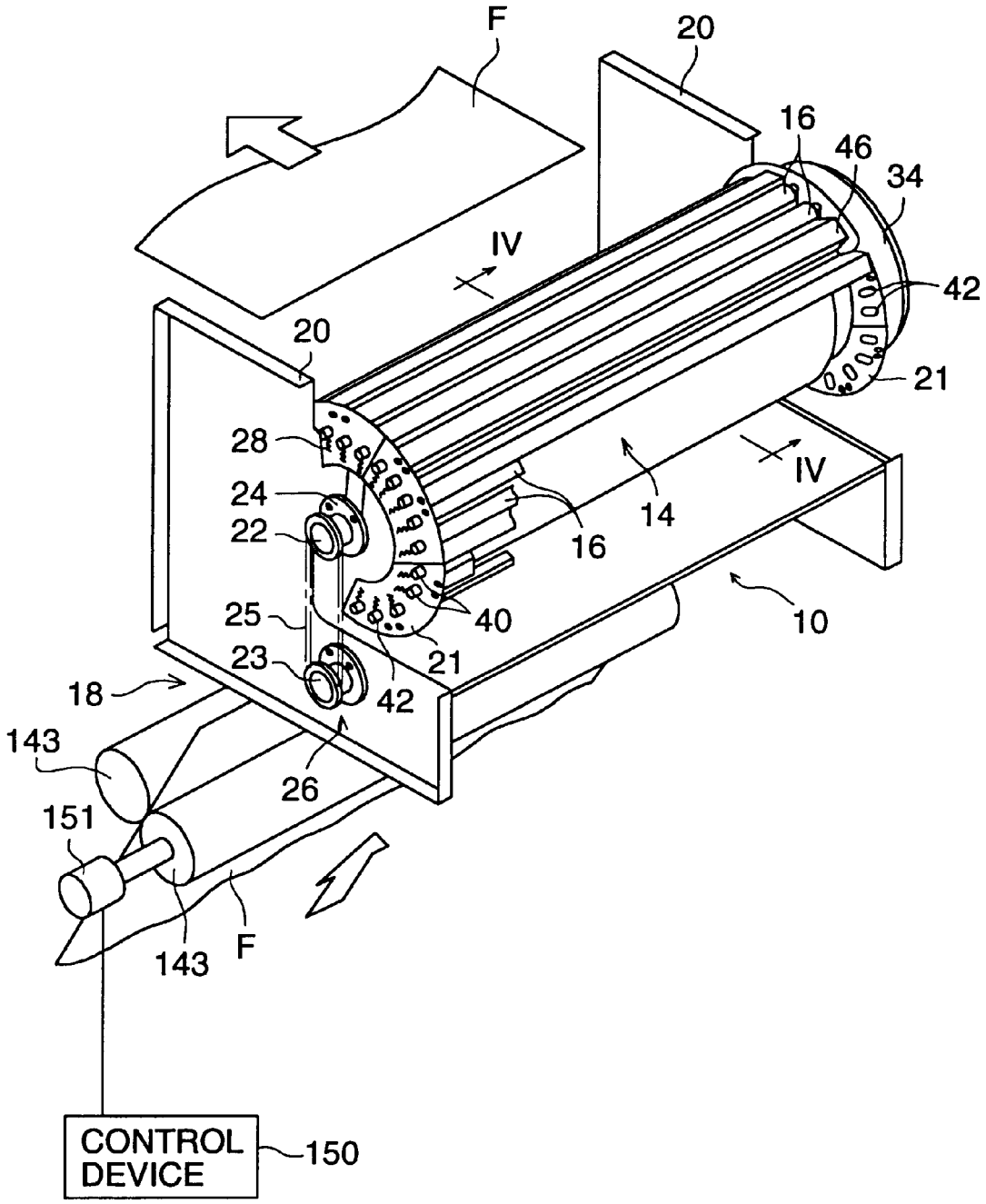
FIG. 4 is a drawing showing the structure of the development section 130 which heats the film F, and a perspective view of the development section 130.
Figure 5:
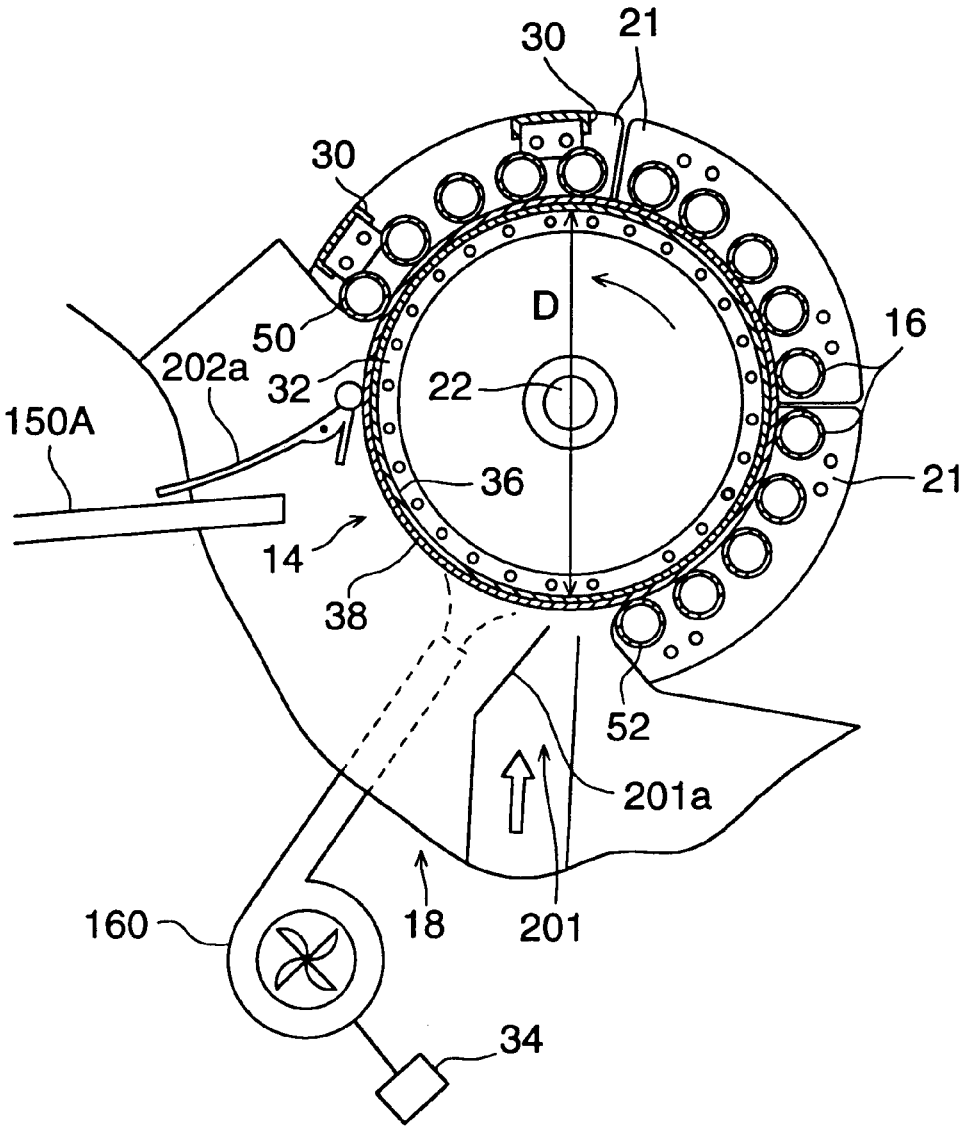
FIG. 5 is the cross-sectional view of the structure shown in FIG. 4 sectioned along the line IV—IV as seen in the direction of the arrow marks.
Figure 6:
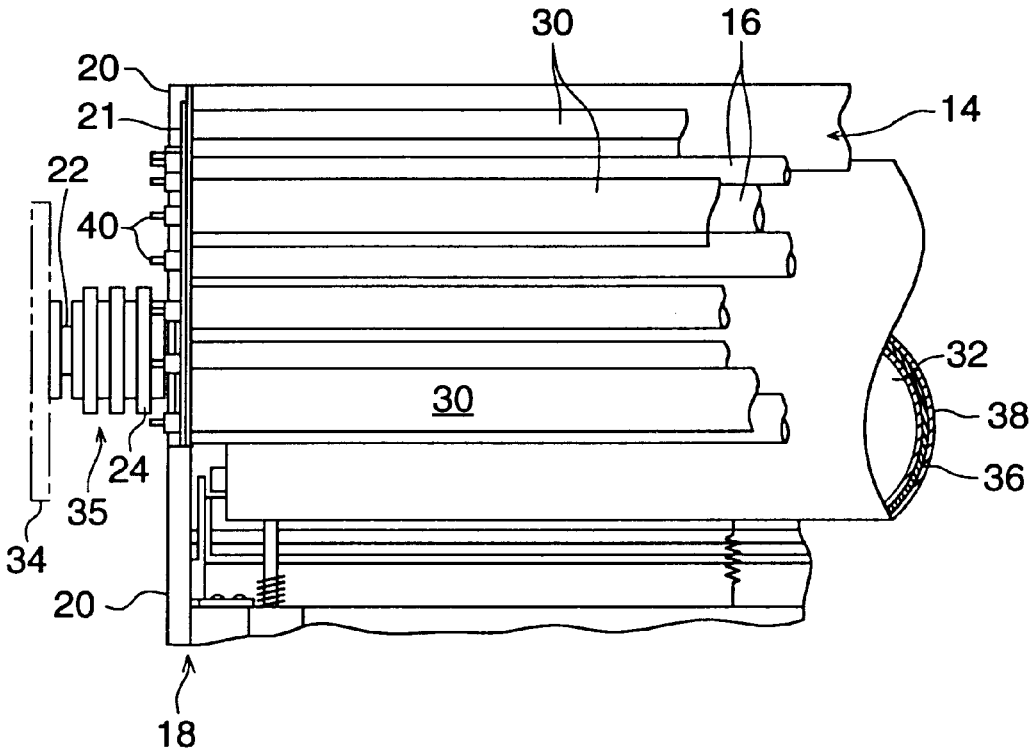
FIG. 6 is the front view of the structure shown in FIG. 4.

FIG. 4 to FIG. 6 are drawings showing the structure of the development section 130 which heats the film F. To state it more concretely, FIG. 4 is a perspective view seen from an oblique rear side, FIG. 5 is the cross-sectional view of the structure shown in FIG. 4 sectioned along the line IV—IV as seen in the direction of the arrow marks, and FIG. 6 is the front view of the structure shown in FIG. 4.

The development section 130 comprises the drum 14 which is capable of heating the film F while holding it on the outer circumference of the drum. The drum 14 thermally develops the film F by keeping the film F at a temperature equal to or higher than the predetermined lowest thermal development temperature for a predetermined thermal development time. In other words, a latent image formed in the film F is formed as a visible image. In the above, the lowest thermal development temperature means the lowest temperature at which a latent image formed in the film F begins to be developed, and it is equal to or higher than 110° C. for the film in this embodiment. Here, a method of measuring the lowest thermally development temperature for a thermally developable material shaped in a sheet such as a film is explained.

(1) Conducts a wedge exposure for a thermally developable material being a object to be measured.

(2) Develops the exposed thermally developable material at a temperature t for a predetermined period of time.

(3) Cools the thermally developed material to an ambient temperature.

(4) Measure the density of the cooled thermally developed material.

Then, steps (1) to (4) are repeated while changing the temperature t at steps (2). In the thermally developed material developed at the temperature t, if a region having a density difference of 0.1 or more for the region exposed with the minimum amount of exposure exists, it deems that the thermally developed material was developed at the temperature t. Therefore, the lowest thermally development temperature means the temperature capable of obtaining the region having a density difference of 0.1 or more for the region exposed with the minimum amount of exposure.

On the other hand, the thermal development time means the time for which the film F is to be kept at a temperature equal to or higher than the lowest thermal development temperature in order to develop a latent image in the film F with desired development characteristics. In other words, the thermal development time means a period of time during which the thermally developable material is on the thermally developing condition mentioned later. In addition, it is needless to say that the film F can not be substantially developed at a temperature equal to or lower than 40° C.

Besides, the thermal development section 130 is built in the thermally developing apparatus 100 together with the exposure section 120 in this embodiment; however, it may be an apparatus which is independent of the exposure section 120. In this case, it is desirable that there is provided a transport portion for transporting the film F from the exposure section 120 to the development section 130. Further, it is desirable that the surrounding portion of the drum 14 is covered by a heat insulating material, because it makes the temperature control of the drum 14 easy to be carried out.

Around the outer circumference of the drum 14, there are provided 27 rollers 16 having a small diameter as guiding members, and they are disposed parallel to the drum 14 and at positions with equal intervals in the circumferential direction of the drum 14. At the both ends of the drum 14, there are provided three guiding brackets 21 for each side supported by the frame 18. In addition, by combining the guiding brackets 21, C shapes facing each other are formed at the both side portions of the drum 14.

Each of the guiding brackets 21 has nine long holes 42 formed extendedly in the direction of the radius. From these long holes 42, the shafts 40 provided at the both sides of the rollers 16 project. One end of each of the coil springs 28 is fixed to each of the shafts 40, and the other end of the coil spring is fixed to a position in the neighborhood of the inner circumference of the guiding bracket 21. Accordingly, each of the rollers 16 is urged to the outer circumference of the drum 14 by a predetermined force based on the urging force of each of the coil springs 28. When the film F enters between the outer circumference of the drum 14 and the rollers 16, it is pressed to the outer circumferential surface of the drum 14 by the above-mentioned predetermined force, and owing to it, the film F is heated uniformly over its whole region so that the film is thermally developed.

The shafts 22, which are linked to the drum 14 in a coaxial manner, are extended to the outside of the end portion members 20 of the frame 18, and are borne by the shaft bearings 24 to be rotatable against the end portion members 20. On the rotary shaft 23 of the micro-stepping motor (not shown in the drawing), which is disposed under one of the shafts 22 and fixed to one of the end portion members 20, a gear (not shown in the drawing) is formed. On the other hand, a gear is formed on the shaft 22. Through the timing belt (a belt having gear teeth formed on the inner side) 25, the driving force of the micro-stepping motor is transmitted to the shaft 22, and the drum 14 is rotated by it. In addition, the transmission of the driving force from the rotary shaft 23 to one of the shafts 22 may be done not through a timing belt but through a chain or gear train.

As shown in FIG. 5, in this embodiment, the rollers 16 are arranged over an angular range of about 234 degrees in the direction of circumference of the drum 14. The two reinforcing members 30 (FIG. 5 and FIG. 6) link the two end portion members 20 of the frame 13 to support additionally the both end portion members 20.

On the inner circumferential surface of the drum 14, the plate-shaped heater 32 is attached over the whole circumferential surface, and under the control of the electronic device for controlling 34 shown in FIG. 6, it heats the circumference of the drum 14. The supply of the electric power to the heater 32 is carried out through the slip-ring assembly 35 connected to the electronic device 34.

Besides, in this embodiment, in order to make compact the structure of the thermally developing apparatus 100, the drum 14 is made to have a rotatable cylindrical shape, but another structure may be employed as the means for heating the film F. For example, it is thinkable that the film F is placed on a belt conveyor equipped with a heater, and it is heated while being transported by such a conveyor.

As shown in FIG. 5, the drum 14 comprises the supporting tube 36 made of aluminum denoting a supporting member made of a metal and the soft layer (elastic layer) 38 which is attached to the outside of this supporting tube 36. In addition, the soft layer 38 may be indirectly attached to the supporting tube 36. The supporting tube 36 in this embodiment is let to have the length of 45.7 cm, the thickness of 0.64 cm, and the outer diameter of 16 cm.

Further, it is desirable that the unevenness of the thickness of the supporting tube 36 is let to be within 4%, for example. Moreover, the soft layer 38 is made to have an enough smooth surface in order to improve the condition of close contact with the film F, and it is desirable that the surface roughness Ra of the surface is smaller than 5 $\mu$m (in particular, 2 $\mu$m)

However, the surface roughness Ra concerning certain materials such as one having a silicone rubber for the base material should be equal to or larger than 0.3 $\mu$m in order to prevent the adhesion of the film F to the drum 14. Besides, if the surface roughness is equal to or larger than 0.3 $\mu$m, gases, especially volatile substances are made easy to be exhausted from between the soft layer 38 and the film F.

The soft layer 38 has a sufficient thermal conductivity equal to or higher than 0.3 W/m/°K, and owing to this, the temperature of the outer circumferential surface of the drum 14 can be kept uniform. Besides, in this embodiment, the thermal conductivity of the soft layer is let to be equal to or higher than 0.4 W/m/°K.

Owing to using the soft layer 38, the film F is made to be in more reliable contact with the drum 14 by the rollers 16 without lowering the wear resistance. It is desirable that the soft layer 38 has a Shore A hardness equal to or lower than 70 (in particular, 60) measured by a durometer. In this embodiment, the Shore A hardness measured by a durometer is equal to or lower than 55.

Further, in the present embodiment, some additive for making the thermal conductivity high and a silicone rubber are included, and it is found out that such substances are especially useful for forming the soft layer 38. Although the thermal conductivity of a silicone rubber included in such a material is comparatively low, the pressing performance against the film F and the durability (wear resistance) against the film F are improved.

On the other hand, in order to improve the processing capacity in development, it is necessary to make the thermal conductivity high, and the above-described additive in certain materials contribute to keeping the thermal conductivity high. However, in the material forming the soft layer 38, if the amount of the additive is increased, the pressing performance by the silicone rubber and the durability are lowered; hence, the amount of the additive and the silicone rubber should be optimized within a certain range. Besides, a material including a silicone rubber has an advantage that it is easy to be detached from the film F and is chemically inactive.

It is desirable that the thickness of the soft layer 38 falls within the range from 0.1 mm to 2 mm, and it is possible to use a thinner soft layer than the above-described one; however, there is a problem that the thinner it is made, the lower the function of the soft layer 38 becomes and the more difficult the manufacturing of it becomes. Therefore, it is desirable that the thickness of the soft layer 38 is equal to or larger than 0.3 mm. Further, it is desirable that the dispersion of the thickness of the soft layer 38 is equal to or smaller than 20% (in particular, equal to or smaller than 10%). In this embodiment, it is suppressed to a value equal to or smaller than 5%. Besides, the ratio of the thermal conductivity to the thickness in the soft layer 38 should desirably be equal to or larger than 0.15.

In this embodiment, for the guiding members, the rotatable rollers 16 are used; however, it is possible to use other means such as a small movable belt. In this embodiment, for the rollers 16, tubes made of aluminum having the outer diameter of 1 to 2 cm and the thickness of 2 mm are used. Owing to the rollers being hollow, suppression of the heat conduction is helped, by which the thermal influence of the rollers 16 can be eliminated to the utmost. However, if the first roller in the rollers 16 which first comes in contact with the supplied film F is not made hollow, but is formed of a solid or a hollow but some-material-filled cylinder, the temperature decrease through the heat being taken by the film F in contact becomes difficult to occur owing to the roller having a comparatively large heat capacity; thus, for example, it can be suppressed an unevenness of density such that the image density is different between the portion near the leading edge of the film and portion near the trailing edge of the film.

Further, as described in the above, the urging force of the coil springs 28 is one to determine the pressing force of the rollers 16 to a value such that the film F can be subjected to a sufficient heat transfer through becoming in more reliable contact with the outer circumferential surface of the drum 14; hence, it is necessary to give enough attention to the selection of the value. If the urging force of the coil spring 28 is too small, there is the possibility that the development of an image becomes incomplete because of the heat not uniformly conducting. Accordingly, it is desirable that the urging force from the roller 16 per width of 1 cm of the film F is equal to or larger than 3 g (in particular, equal to or larger than 5 g).

Further, if the urging force from the roller 16 per width of 1 cm of the film F is too smaller than 14 g, it occurs the possibility that the rollers 16 do not rotate following the rotation of the drum 14. In particular, if the urging force is equal to or smaller than 7 g, the rollers do not rotate with the drum. In such cases, if the film F is moved with the rotating drum 14 and the rollers 16 are in contact with the film F, there is the possibility that the film F is damaged by the rollers 16. In such cases, it is desirable that driven rotary portions are provided at the both ends of these rollers, and the rollers 16 are rotated by gear driving or friction driving through these driven rotary portions.

On the other hand, the urging force of the coil spring 28 should be small to a degree such that the rollers 16 do not produce traces by pressing. Accordingly, it is desirable that the urging force from the roller 16 per width of 1 cm of the film F is equal to or smaller than 200 g (in particular, equal to or smaller than 100 g). In this embodiment, this force per 1 cm in the direction of the width of the film F is between 5 g and 7 g. In addition to it, driven rotary portions (not illustrated in the drawings) are provided at the both ends of the rollers 16, and the rollers are driven to rotate by gear driving through these driven rotary portions, to keep the force in the above-described range; hence, the harmonization of the decreasing the traces by pressing and the decreasing of the unevenness in the image can be secured.

Besides, it is suitable to determine the urging force by the every coil spring 28 when they are used for the rollers 16 provided around the cylindrical drum 14 by taking into consideration the gravity acted on the every roller 16. For example, if the urging force of a coil spring 28 urging a roller 16 which is located at the upper side of the drum 14 is made smaller in accordance with the weight of the roller 16 than that of another coil spring 28 urging a roller which is located at the bottom side of the drum 14, approximately the same pressure can be acted for the whole region of the film F.

In addition to the force acted by the every roller 16, the space between the neighboring rollers 16 is important for making a high-quality image formation in the film F. When the film F is supplied to the drum 14, its temperature is generally the room temperature (about 20° C.). Accordingly, in order to make the processing capacity of the development section 130 be the maximum limit, the film F should be rapidly heated from the room temperature to the lowest thermal development temperature required for starting the development (124° C. in this embodiment)

However, there is a possibility that a substrate material which is included in a certain kind of the film F, for example, a plate material having polyester film as the base, or a plate material having other thermoplastic material as the base makes thermal expansion or contraction (diminish in size) when it is heated. Accordingly, in order to make the variation of size uniform to prevent the formation of creases (folds), the film F must be heated uniformly while it changes alternately the condition between the flat-held condition and the non-constrained condition. In order to actualize this, the plural rollers 16 are arranged with a spacing such that the variation of the region (domain) of the film F located between the neighboring rollers 16 can be allowed, when the film F is not constrained between the rollers 16 and the drum 14.

However, as described in the above, in order to conduct heat sufficiently and uniformly for the uniform development of the film F, the rollers 16 must be held for a predetermined time in the condition of holding the film F being urged to the drum 14. As the result of this, the space located between the neighboring rollers 16 is to be selected to be a value such that the creases (folds) is made minimum and the heating of the film F is carried out rapidly and uniformly.

Further, on the outer circumferential surface of the cylindrical drum 14, the leading edge portion of the film F extends in the direction of the tangent of the drum 14 between the neighboring rollers owing to its own rigidity; hence, in order to suppress this, the rollers must be enough close to one another. Such arrangement is important for holding the film F between the rollers 16 and the drum 14. In order to achieve the above, it may be preferable that the diameter of the drum 14 is 5 cm to 30 cm and the diameter of the roller 16 is 0.5 cm to 2 cm. Especially, this is effective for thermally developing a film whose base has a thickness of 0.1 mm to 0.2 mm.

As shown in FIG. 4 to FIG. 6, the 27 rollers 16 are disposed over the angular range of 234 degrees in the direction of rotation of the drum 14, and every distance between the centers of the neighboring rollers is 9 degrees. This structure acts effectively for the comparatively hard film F such as a film comprising the base having a thickness in the range from 0.1 mm to 0.2 mm, for example, a polyester film comprising the base having the thickness of 0.18 mm, and for the film F with a smaller hardness such as a polyester film comprising the base having the thickness of 0.10 mm in the case that the diameter of the drum 14 is 16 cm and the diameter of the roller 16 is 1.2 cm.

The heater 32 is attached to the inner circumference of the drum 14 in order to heat the outer circumferential surface of the drum 14. For the heater 32 for heating the drum 14, a resistive foil heater which is made by etching can be used.

The electronic device 34 for controlling the heater as a temperature control means is capable of adjusting the electric power supplied to the heater 32 in accordance with the temperature information sensed by the temperature sensors S1 to S4 as temperature detecting means (FIG. 9) which rotate with the drum 14 and are disposed in the drum 14. The detail of the temperature control will be described later. The adjustment for the temperature of the outer circumferential surface of the drum 14 can be made by the heater 32 and the electronic device 34 for controlling the heater in order to make the temperature suitable for the development of the particular film F. In this embodiment, the drum 14 can be heated to a temperature in the range of 60° C. to 160° C. by the heater 32 and the electronic device 34 for controlling the heater.

In the above, it is desirable that the temperature variation in the direction of the width of the drum 14 (the axial direction of the drum 14) is kept within the range of 2.0° C. (in particular, within the range of 1.0° C.) by the heater 32 and the electronic device 34 for controlling the heater. In this embodiment, it is kept within the range of 0.5° C.

The undeveloped film F which has been supplied from the supply roller pair 143 at the predetermined timing is supplied to the nip portion 52 which is formed by the heating member (drum) 14 and the roller 16 located at the most upstream side in the development section 130. Next, the film F revolves with the drum 14. At this time, the film F is urged to the drum 14 by the rollers 16, and is made to be in contact with the outer circumference of the drum 14 for a predetermined time during revolution.

Because the drum 14 can move at an approximately equal speed to the film F which is being developed, there is a low possibility that the surface of the film F is damaged; owing to this, a high quality image can be secured. The film F, which has been developed while being transported between the drum 14 and the rollers 16, is guided to the nip portion formed by the roller 16 which is located at the most downstream side and the drum 14, and is drawn out from the development section 130.

The development section 130 has a structure such that the various kinds of films F composed of a polyester base etc. coated, for example, with a photosensitive thermal development emulsion layer including infrared sensitive silver halide as shown in the example of practice can be developed. The drum 14 is kept at a temperature between 115° C. and 138° C. during the thermal development, for example, at 124° C., and said drum 14 is rotated at a speed such that the film F is held for 15 seconds on its outer circumferential surface in the condition of close contact, which is the predetermined time. That is, the temperature of the film F can be raised to 124° C. with this predetermined time and the above temperature, for example, by keeping the drum temperature at 124° C.

It is desirable that the surface at the side of the photosensitive thermal development emulsion layer of the film F is contact with the outer circumferential surface of the drum 14 (the soft layer 38 in this embodiment). However, the opposite side of the film F may be brought in contact with the outer circumferential surface of the drum 14 (the soft layer 38 in this embodiment).

Next to the thermal development of the image, the film F is detached from the surface of the drum 14 in the development section 130 by the detaching member 202*a*, and is guided to the direction apart from the surface of the drum 14; after that, it is guided to the direction of the cooling device 150A. By cooling the film after the development in the above manner, there is a low possibility of the film being damaged and also of the surface being worn. Further, the developed film F is first gradually cooled and later rapidly cooled in the cooling device.

In the following, this detaching member 202*a* will be explained with reference to FIG. 11 which is a perspective view of it. The edge 221 of the detaching member 202*a* has a sharpened cross-section and keeps a predetermined spacing to the outer circumferential surface of the drum 14 by the rolling spacer bars 210 provided at the both sides of the leading edge of the detaching member 202*a*. It is desirable that this predetermined spacing falls within the range of 0.2 to 0.8 times the thickness of the film to obtain a good detaching capability.

Figure 7:
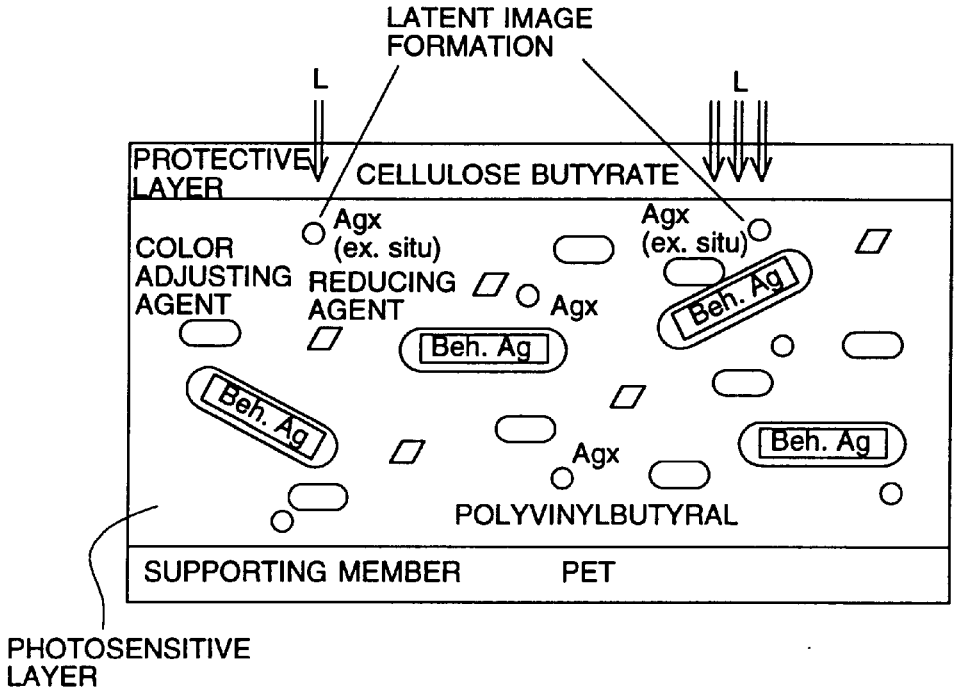
FIG. 7 is a cross-sectional view of the film F, and is a drawing showing schematically the chemical reaction in the film F at the time of exposure.
Figure 8:
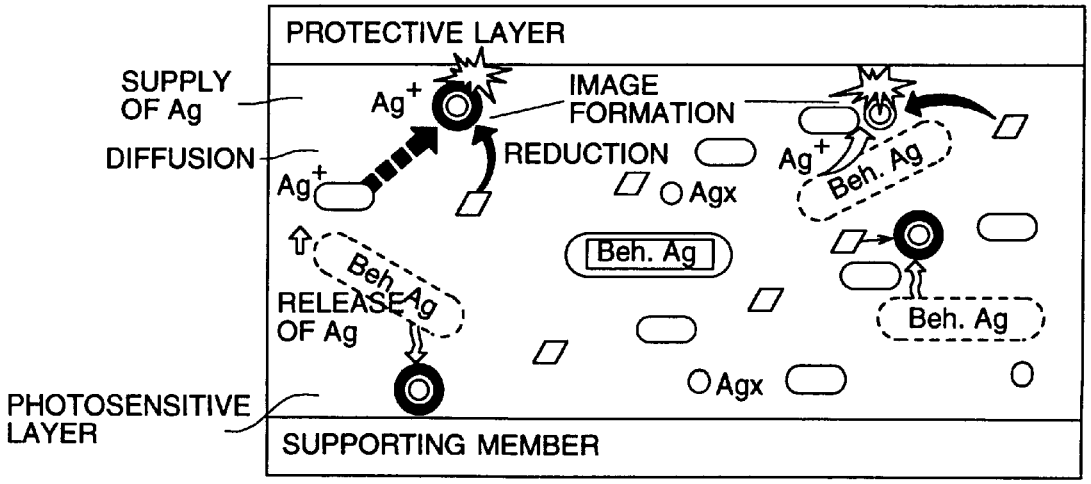
FIG. 8 is a cross-sectional view similar to FIG. 7 showing schematically the chemical reaction in the film F at the time of heating.

FIG. 7 is a cross-sectional view of the film F shown in the example of practice, and is a drawing showing schematically the chemical reaction in the film F at the time of exposure. FIG. 8 is a cross-sectional view similar to FIG. 7 showing schematically the chemical reaction in the film F at the time of heating. The film F has a photosensitive layer mainly composed of a polyvinylbutyral formed on a supporting member (base layer) composed of a PET, and further a protective layer composed of a cellulose butyrate formed on them. In the photosensitive layer, there are mixed silver behenate (Beh. Ag), a reducing agent, and a color adjusting agent.

At the time of exposure, when the laser beam L irradiates the film F from the exposure section 120, as shown in FIG. 7, the silver halide particles receive the light to form a latent image in the region irradiated by the laser beam L. Further, when the film F is heated, as shown in FIG. 8, silver ions ($Ag^+$) are released from silver behenate particles, and the silver behenate particles which have released silver ions form a complex compound with the color adjusting agent. It seems that the silver ions diffuse after that, and a latent image is formed by a chemical reaction through the action of the reducing agent with the silver halide particles which have sensed the light made as nuclei. As described in the above, the film F has a structure such that it includes photosensitive silver halide particles, organic silver salt particles, and a silver ion reducing agent, and is not thermally developed substantially at a temperature equal to or lower than 40° C., and is thermally developed at a temperature equal to or higher than the lowest thermal development temperature, namely, 80° C.

Incidentally, sometimes unevenness is produced in the density of images formed owing to the non-uniformity in the temperature of a sheet-shaped thermally developable material (film F), if it is not heated uniformly. Accordingly, it is necessary to heat the outer circumference of the drum 14 in a manner such that the temperature becomes uniform, for example, at about 120° C. over the whole circumference.

On the other hand, it is convenient if films having different sizes (for example, sizes of A3, A4, etc.) in the axial (width) direction of the drum can be developed by one and the same thermally developing apparatus. However, when it is intended to heat a large-sized film after a small-sized film is heated, it poses a problem to be described later.

When a film F, which has been stored at room temperature, is supplied onto the outer circumferential surface of the drum 14, the temperature of the outer circumferential surface of the drum 14 drops in the region which has become in contact with the film F. Now, in the case where a film F having such a large size as is approximately equal to the length of the drum 14 in the axial direction is supplied, non-uniformity of temperature is not produced in the film F which is supplied next, because the whole circumferential surface of the drum 14 has been cooled.

Figure 9:
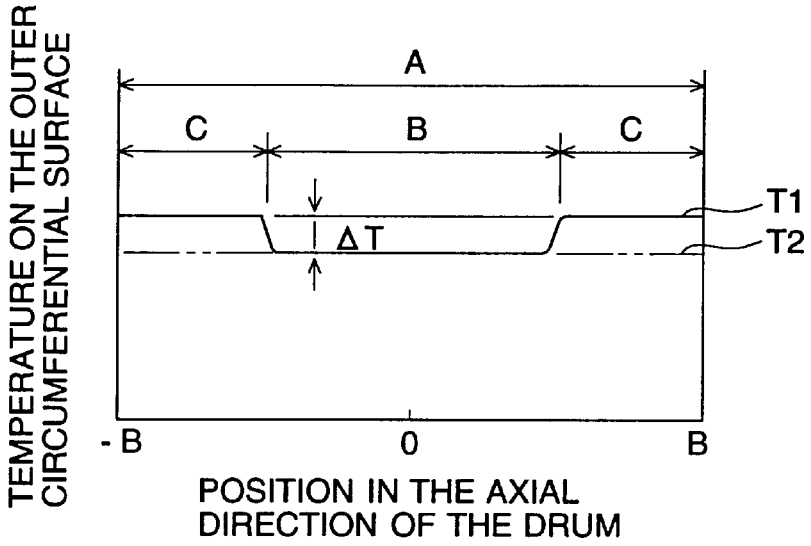
FIG. 9 is a drawing showing a temperature of the outer circumferential surface of the drum on the axis of ordinates and a length on the axial direction of the drum on the axis of abscissas.

However, in the case where a film having a short size in the axial direction of the drum 14 is supplied to the drum 14, the following problem is produced. FIG. 9 is a drawing showing a graph in which the temperature of the outer circumferential surface of the drum 14 is taken for the ordinate and the length in the axial direction of the drum 14 is taken for the abscissa. Besides, A denotes the length in the axial direction of the effective heating region of the drum 14.

In FIG. 9, assuming that a film having the small width B in the axial direction of the drum is supplied to the central portion of the drum, the surface temperature drops by $\Delta T$ over the width B. In this case, next, when a large-sized film (width A) is supplied successively in such a manner as to cover the region where temperature has dropped, non-uniformity of temperature such that it is lower in the central portion and higher in both side regions is produced in one and the same film heated by the drum 14, and owing to this, it is possible that unevenness of image density is brought about. For such a problem as described in the above, according to this embodiment, the non-uniformity of the temperature on the outer circumferential surface in the drum 14 is eliminated, by which the non-uniformity of the temperature of the film can be prevented. A thermally developing apparatus as mentioned above will be explained below.

Figure 10:
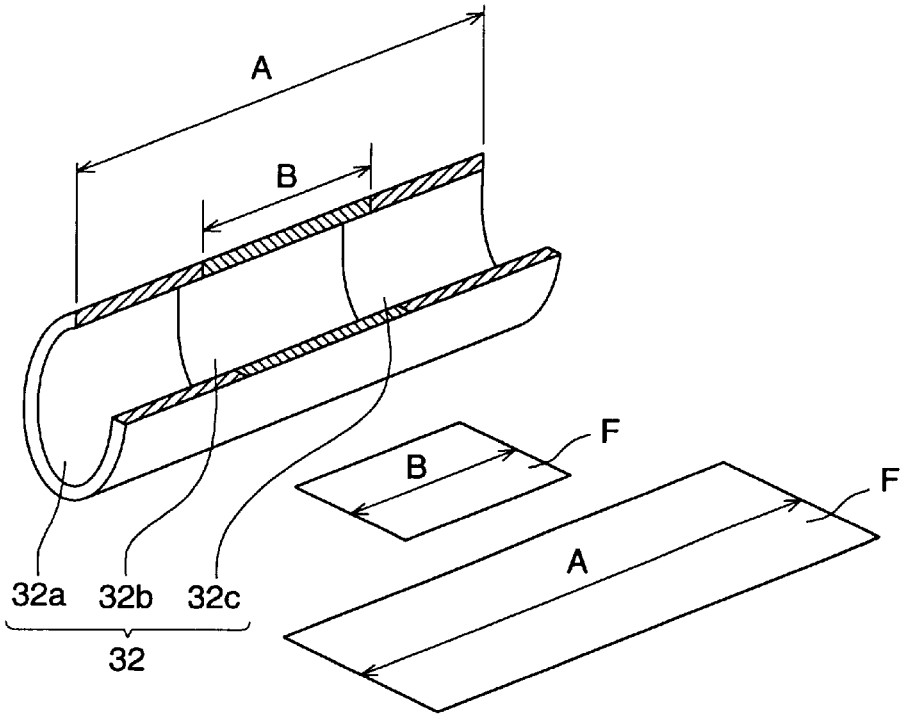
FIG. 10 is a perspective view of the second embodiment.

FIG. 10 is a perspective view showing the drum 14 of the first example with a part of it omitted. In FIG. 10, the heaters 32 and temperature sensors are provided respectively in the regions 32*a*, 32*b*, and 32*c* which are formed by dividing the drum 14 into three portions in the axial direction (the direction of the rotational axis), and each of the heaters 32 corresponding to the above regions is independently controlled for the temperature by the respective temperature sensor through the electronic device for control 34. Incidentally, in the following explanation, it is supposed that the width of the central region 32*b* is let to agree with the width B of a small-sized film F, and the width of the total regions 32*a*, 32*b*, and 32*c* is let to agree with the width A of a large-sized film F. In addition, it is appropriate to measure the temperatures over the whole surface of the circumference of the drum 14 by using a multi-point thermocouple or the like.

In the following, the operation of the first example will be explained. The electronic device for control 34 can judge the size of a film F on the basis of a signal from the cassette C (FIG. 1) from which the film F was taken out. If the electronic device for control 34 judges that a small-sized film F having the width B has been supplied, it makes a control such that the temperature (control target temperature) in the both side regions 32*a* and 32*c* becomes a temperature adapted to the temperature drop of the central region 32*b* of the outer circumferential surface of the drum 14 owing to the supply of the film F, to suppress the generation of a temperature difference, through heating with a target temperature value of control for the side regions 32*a* and 32*c* set lower than that of the central region 32*b*.

If the electronic device for control 34 judges that a large-sized film F having the width A has been supplied on the basis of the signal from the cassette C (FIG. 1) from which the film F was taken out, it makes a temperature control in the same way for both the central region 32*b* and the side regions 32*a* and 32*c*.

By the above-described operation, the temperature of the heating member for heating the thermally developable materials is kept constant in the axial direction as shown by the double dot and a dash line T2 regardless of the size of the supplied film F.

Next, the second example will be explained. The second example is different from the first example only in the way of control. In the following, only the different points will be explained. The electronic device for control 34 selects the cassette C (FIG. 1) from which a film F should by taken out in accordance with the size of the film for recording an image (for example, the size of the image data), and controls the heating by the heaters after the thermal development of the preceding film F has been completed until the thermal development of the present film F is completed. If the film F is a small-sized film F having the width B, it makes a control such that the temperatures of the both side regions 32*a* and 32*c* become a temperature adapted to the temperature drop of the central region 32*b* of the outer circumferential surface of the drum 14 owing to the supply of the film F to suppress the generation of a temperature difference, through heating with a target temperature value of control for the side regions 32*a* and 32*c* set lower than that of the central region 32*b*. If the film F is a large film having the width A, it carries out a control in order to make the temperature of the side regions 32*a* and 32*c* of the outer circumferential surface of the drum 14 and the temperature of the central region 32*b*, both of which is affected by the supply of the film F, become the same, through heating the central region 32*a* in the same way as the both side regions 32*a* and 32*c*.

Figure 11:
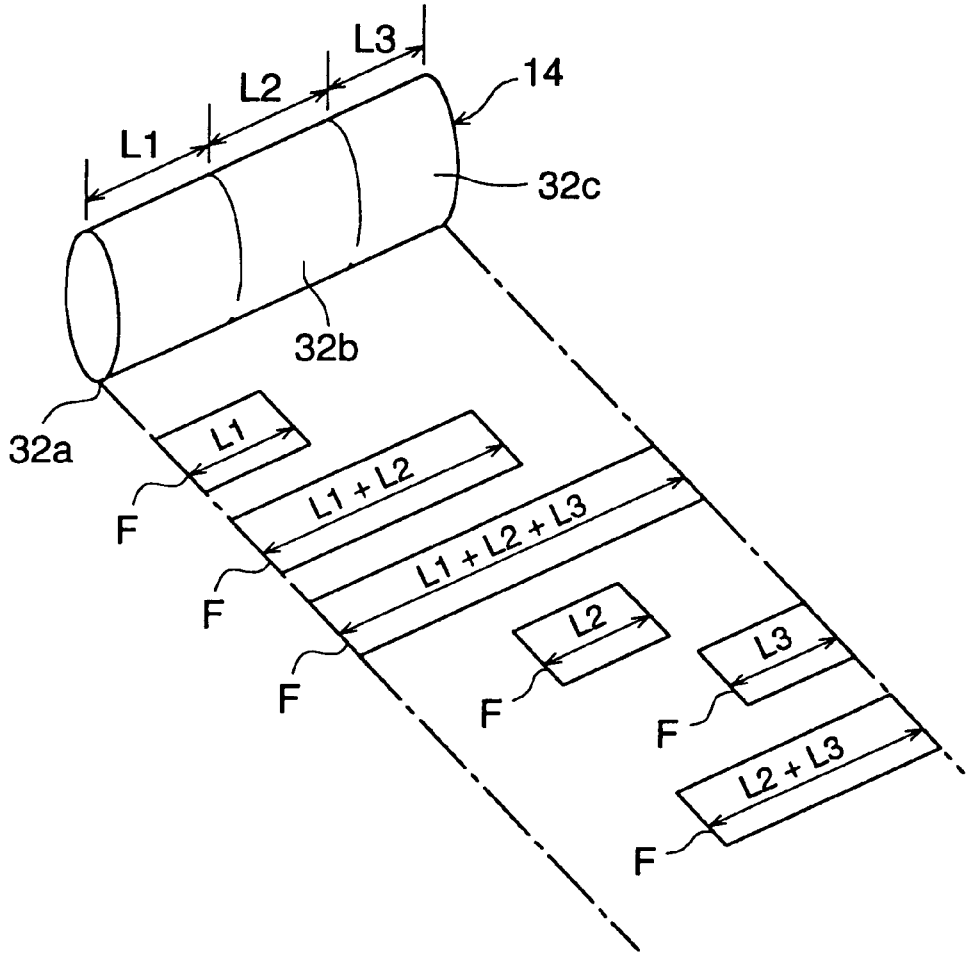
FIG. 11 is a perspective view of the third embodiment.

FIG. 11 is a drawing showing the relationship between the drum and film of the second example. In the second example, the three regions for temperature control 32*a*, 32*b*, and 32*c* formed by dividing the total region in the axial direction of the drum 14 have lengths in the axial direction L1, L2, and L3 respectively. According to this embodiment, films having different sizes in six ways, namely, the widths L1, L1+L2, L1+L2+L3, L2, L3, L2+L3 can be heated uniformly. Concerning the mode of temperature adjusting, the detail will not be described because it is similar to the second example.

Besides, in this embodiment, the heater is divided in the axial direction of the drum 14; however, it is not limited to this, but the heater 32 may be divided in the circumferential direction to be able to be controlled independently in order that it may cope with the films F having different sizes in the transport direction. Further, the temperature of such heaters can be controlled also in a manner to make it continuously variable.

Further, it is thinkable to control the heating of the drum 14 by the plane-shaped heater 32 which is provided in a close contact condition with the inner circumference of the drum 14, in accordance with the information concerning the timing for supplying the film F to the surface of the drum 14 and has been obtained by the sensor 152 shown in FIG. 4. That is, the temperature of the outer circumferential surface of the drum 14 can be made constant to the utmost by it that, on the basis of the information obtained from the sensor 152, the quantity of the heat generated by the heater 32 is increased while the film F is supplied, and the quantity of the heat generated by the heater 32 is decreased while the film F is not supplied; owing to it, unevenness of density can be suppressed.

Further, it is desirable that the target value of the heater 32 is made to be varied in accordance with the timing in thermally developing the film F. For example, by making the amount of heat generation of the heater 32 increase during the state where the drum 14 thermally develops the film F, and making the amount of heat generation of the heater 32 decrease during the state where the drum 14 does not thermally develop the film F, the temperature of the outer circumferential surface of the drum 14 can be made uniform to the utmost, by which unevenness of density can be suppressed. In the above, "during the state where the drum 14 thermally develops the film F" means "from the timing at which the leading edge of the film F first comes in contact with the drum 14 to the timing at which the trailing edge of the film F first comes in contact with the drum F", and "during the state where the drum 14 does not thermally develop the film F" means "during the time period other than the above". Further, the reason for specifying the target value of the heater 32 is because it is included in the both ways of temperature control, that is, carrying out the temperature control by directly measuring the temperature of the heater 32 and carrying out the temperature control by measuring the temperature of the supporting tube 36 which is adjacent to the heater 32.

Figure 12:
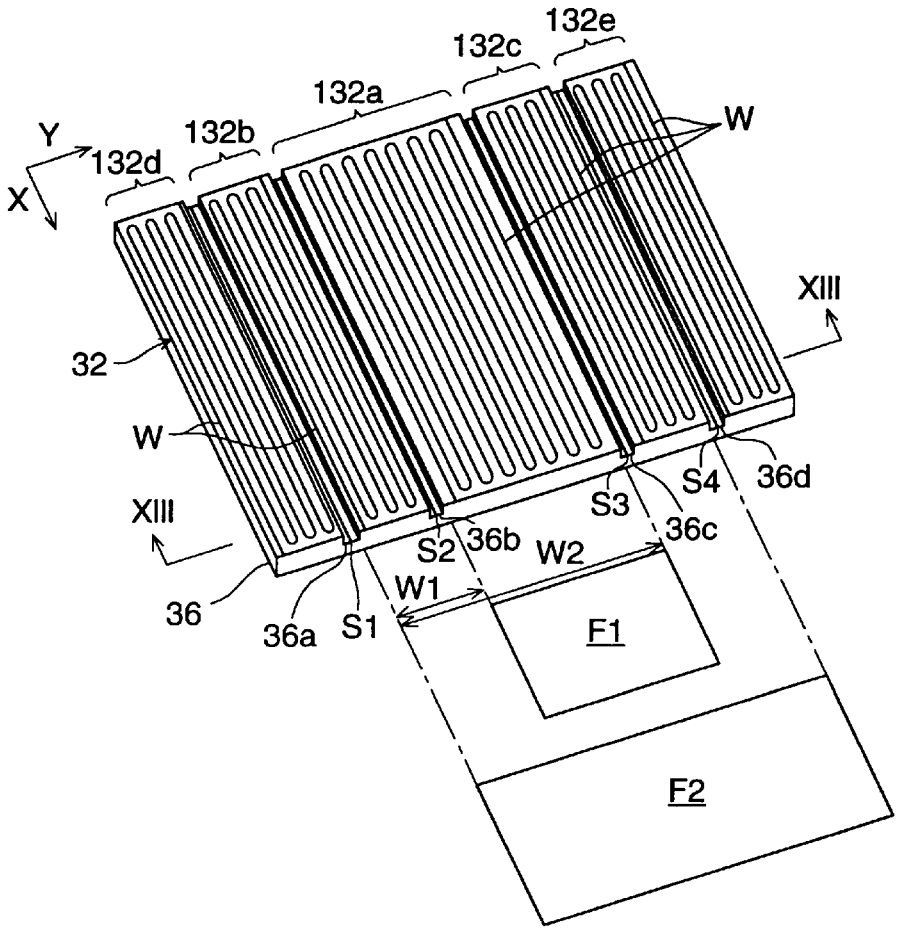
FIG. 12 is a drawing showing a developed view of a supporting tube 36 according to another embodiment.
Figure 13:
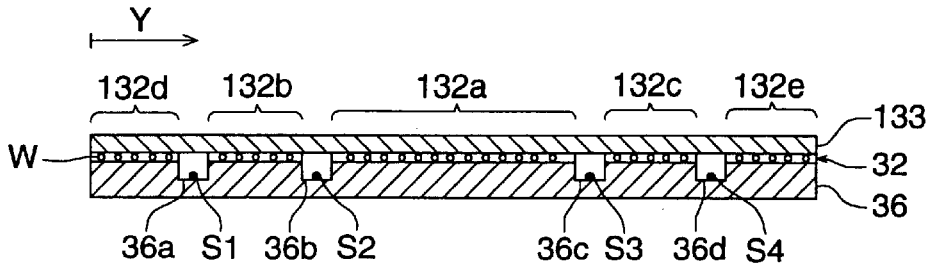
FIG. 13 is the cross-sectional view of the structure shown in FIG. 12 sectioned along the line XIII—XIII as seen in the direction of the arrow marks.

FIG. 12 is a drawing showing in a developed state the supporting tube 36 of another embodiment of the invention. FIG. 13 is the cross-sectional view of the structure shown in FIG. 12 sectioned along the line XIII—XIII as seen in the direction of the arrow mark. In FIG. 12, the Y direction corresponds to the width direction of the film F (the direction perpendicular to the supplying direction to the drum 14, that is, the axial direction of the drum 14), and the X direction corresponds to the length direction of the film F. The outer circumferential surface of the drum 14 comes to the lower surface side. The plane-shaped heater 32 is formed by putting a Nichrome wire w or the like close to the surface (inner circumferential surface) of the supporting tube 36 with a fine pitch in a zigzag way, and is divided into the central region 132*a* which is approximately one third of the total length of the supporting tube 36 in the width direction (the axial direction of the drum 14), the side regions adjacent to it in the Y direction 132*b* and 132*c*, and the most outer regions at the farther outsides 132*d* and 132*e*. In each of the regions 132*a* to 132*e*, the heater 32 can be independently controlled for the temperature.

On the surface of the supporting tube 36 between the most outer region 132*d* and the side region 132*b*, the slot 36*a* is formed, on the surface of the supporting tube 36 between the side region 132*b* and the central region 132*a*, the slot 36*b* is formed, on the surface of the supporting tube 36 between the central region 132*a* and the side region 132*c*, the slot 36*c* is formed, and on the surface of the supporting tube 36 between the side region 132*c* and the most outer region 132*e*, the slot 36*d* is formed. In the slot 36*a*, the wire-shaped temperature sensor S1 is disposed in close contact with the supporting tube, in the slot 36*b*, the wire-shaped temperature sensor S2 is disposed in close contact with the supporting tube, in the slot 36*c*, the wire-shaped temperature sensor S3 is disposed in close contact with the supporting tube, and in the slot 36*d*, the wire-shaped temperature sensor S4 is disposed in close contact with the supporting tube. The temperature sensors S1 to S4 can measure not the temperature of the heater 32 but the temperature of the supporting tube 36 by using its own resistance varying with the temperature. Because each of the slots 36*a* to 36*d* functions as a clearance, each of the regions of the heater 32 is kept in a isolated state. Besides, although it is not shown in FIG. 12, the heater 32 and the temperature sensors S1 to S4 are covered by a heat insulating layer 133 (FIG. 13).

The temperature control for each of the regions 132*a* to 132*e* of the supporting tube 36 is carried out by the electronic device for control 34 controlling the heat generation of each of the heaters 32 corresponding to each of the regions 132*a* to 132*e* in accordance with the result detected by the temperature sensors S1, S2, S3, and S4. To state it concretely, in accordance with the temperature values detected by the temperature sensors adjacent to the respective regions of the supporting tube 36, the heaters 32 are controlled by the electronic device for control 34 in order that the temperatures of the respective regions of the supporting tube may become the target values of control respectively. For example, the temperature control of the region 132*a* is carried out, in accordance with the result detected by the temperature sensors S2 and S3, which are adjacent to the region 132*a*, by the electronic device for control 34 controlling the heat generation of the heater 32 corresponding to the region 132*a* in order that the temperature of the region 132*a* may become the target value of control for the region 132*a*, and the temperature control of the region 132*e* is carried out, in accordance with the result detected by the temperature sensors S4, which is adjacent to the region 132*e*, by the electronic device for control 34 controlling the heat generation of the heater 32 corresponding to the region 132*e* in order that the temperature of the region 132*e* may become the target value of control for the region 132*e*. As described in this embodiment, by providing the temperature sensors S1 to S4 in close contact with the supporting tube 36 as the heating member not in contact with the heater 32, a temperature control having a higher precision is made possible, because the sensors can measure the temperature of the supporting tube which is nearer to the temperature of the film F, without measuring the temperature of the heaters 32 directly.

Now, if the film F1 having a width approximately equal to the width of the central region 132*a* is supplied to the drum 14, the heater 32 for the central region 132*a* is controlled so as to generate more heat than it generates while no film is supplied to the region 132*a*, because the central region is cooled by the film F1; however, the temperatures of the side regions 132*b* and 132*c* are also raised with it.

Therefore, according to this embodiment, regarding the target values of control for the heaters 32 disposed in the range in the transport-width direction which the film F1 does not pass (that is, the side regions 132*b* and 132*c*, the values set during the time period substantially from the timing at which the leading edge of the film F1 first comes in contact with the drum 14 to the timing at which the trailing edge of the film F1 first comes in contact with the drum 14 are made to be lower than the values set during the time period other than the above; hence, it can be prevented that the temperatures of the side regions 132*b* and 132*c* are excessively raised by the heating of the central region 132*a* owing to the supply of the film F1, by which the non-uniformity of the temperature of the drum 14 in the width direction of the film F1 can be suppressed. Besides, with respect to the most outer regions 132*d* and 132*e*, it is desirable that the target values of control in such a case is not varied or very little if varied, because the influence of the temperature of the central region is almost nothing.

Further, according to this embodiment, regarding the target value of control for the heater 32 disposed in the region including the range in the transport-width direction which the film F1 passes (the central region 132*a* in this example), the value set during the time period substantially from the timing at which the leading edge of the film F1 first comes in contact with the drum 14 to the timing at which the trailing edge of the film F1 first comes in contact with the drum 14 is made to be higher than the value set during the time period other than the above; hence, the temperature drop in the central region 132*a* owing to the supply of the film F1 can be suppressed, by which the non-uniformity of the temperature of the drum 14 in the width direction of the film F1 can be suppressed.

It is desirable that the temperature control, which has made as the target values, the value set during the time period substantially from the timing at which the leading edge of the film F1 first comes in contact with the drum 14 to the timing at which the trailing edge of the film F1 first comes in contact with the drum 14, and the value set during the time period other than the above, is made to be smoothed by ramp processing, because a smoother temperature control can be accomplished.

Next, when the film F2 having a width which is approximately equal to the width of the central region 132*a* added by the side regions 132*b* and 132*c*, the heaters 32 for the central region 132*a*, and the side regions 132*b* and 132*c* are controlled so as to increase the amount of heating, because the central region 132*a*, and the side regions 132*b* and 132*c* are cooled by the film F2; however, the temperatures of the most outer regions 32*d* and 32*e* are raised with it.

Therefore, according to this embodiment, regarding the target values of control for the heaters 32 disposed in the range in the transport-width direction which the film F2 does not pass (that is, the most outer regions 132*d* and 132*e*), the values set during the time period substantially from the timing at which the leading edge of the film F2 first comes in contact with the drum 14 to the timing at which the trailing edge of the film F2 first comes in contact with the drum 14 are made to be lower than the values set during the time period other than the above; hence, it can be prevented that the temperatures of the most outer regions 132*d* and 132*e* are excessively raised by the heating of the central region 132*a*, and the side regions 132*b* and 132*c* based on the supply of the film F2, by which the non-uniformity of the temperature of the drum 14 in the width direction of the film F2 can be suppressed.

Further, according to this embodiment, regarding the target values of control for the heaters 32 disposed in the region including the range in the transport-width direction which the film F2 passes (that is, the central region 132*a* and the side regions 132*b* and 132*c*, the values set during the time period substantially from the timing at which the leading edge of the film F2 first comes in contact with the drum 14 to the timing at which the trailing edge of the film F2 first comes in contact with the drum 14 are made to be higher than the values set during the time period other than the above; hence, the temperature drop in the central region 132*a* and the side regions 132*b* and 132*c* owing to the supply of the film F2 can be suppressed, by which the non-uniformity of the temperature of the drum 14 in the width direction of the film F2 can be suppressed. In this case, it is appropriate, with the heat conduction to the outermost regions 132*d* and 132*e* taken into consideration, to set the target values of control for the side regions 132*b* and 132*c* to a higher value than the central region 132*a*, but it is not limited to this.

Besides, as described in the above, because the control of the heaters can be made for the respective regions 132*a* to 132*e* individually, for example, the film having a width equal to the width of the side region 132*b* w1, and also the film having a width equal to the width of the central region 132*a* and the side region 132*b* w2 can be thermally developed suitably by carrying out the above-described control. However, because the central region 132*a* is most difficult to have its temperature varied, it is desirable that all the films are made to pass this region 132*a* regardless of the size.

It is desirable if the temperature control of the heater 32 is carried out using a method of controlling the ON/OFF duty ratio, because it makes it possible to simplify the control device. Further, in controlling temperature, it is desirable to carry out the control for the target value using so called an integral control or a derivative control, because of the rapid converging of the temperature. In addition, the term "an integral control or a derivative control" includes the case where a value equivalent to the integral value with time or the derivative value with time such as a value averaged for the passage of time is used, in addition to the case where an integral value or a derivative value is directly used.

Further, it is desirable that the ratio of the sum of the heat quantities M to be generated by all the heaters to the sum of the maximum heat quantities Hmax to be generated by all the heaters during the time period while the drum 14 brings a film F in the thermal development state satisfies the following inequality:

$$0.04 \leqq M/Hmax \leqq 0.75 \quad (1)$$

To state it concretely, it is to the purpose that the electronic device for control 34 controls the heaters 32 so as to make the heat quantity M generated by the heaters 32 satisfy the inequality (1) while a thermally developable material is thermally developed on the drum 14. In the above, Hmax (J) can be obtained as the product of the maximum voltage to be applied to the heaters (V), the maximum current (A) which flows when the maximum voltage is applied to the heaters, and the time (s) for thermally developing a sheet of thermally developable material.

Further, M (J) can be obtained as the product of the apparent specific heat which is obtained from it that a sheet of thermally developable material having a predetermined region or a predetermined mass is heated by a constant pressure calorimeter which is defined by JIS K0215 from room temperature to the thermal development temperature, the temperature difference between room temperature and the thermal development temperature, and the region or the mass of the sheet of thermally developable material.

Figure 14:
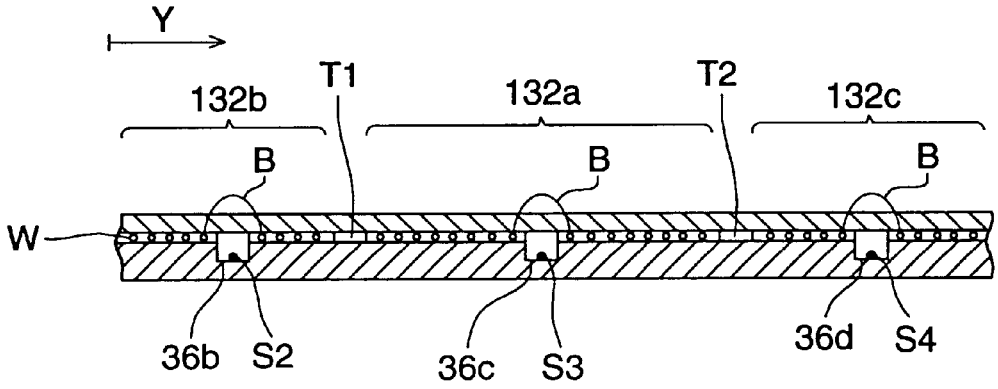
FIG. 14 is a drawing which is similar to FIG. 13 and shows still another embodiment.

FIG. 14 is a cross-sectional view similar to FIG. 13 showing a further embodiment, in which both side portions in Y direction are omitted. The different point of the embodiment shown in FIG. 14 from the embodiment shown in FIG. 13 is the positional relationship between the heaters 32 and the slots 36*a* to 36*e* in which the temperature sensors S1 to S5 are provided respectively. To state it more concretely, the heater 32 in each of the regions 132*a* to 132*e* is divided into to portions with a clearance in between, and the divisional heaters are connected by a lead wire B to each other so as to make them become to the same temperature, while the slots 36*a* to 36*e* are formed at the clearances between the divisional heaters, and the temperature sensors S1 to S5 are disposed in close contact with the bottom of these slots 36*a* to 36*e* respectively.

According to the structure shown in FIG. 13, for example, the temperature sensor S2 between the side region 132*b* and the central region 132*a* measures the average value of the temperature of the range corresponding to the side region 132*b* and the temperature of the range corresponding to the central region 132*a*, both regions being adjacent to the slot 36*b* in which it is provided; hence, it is necessary to make a correction to some extent when it is used for the control of the side region 132*b*.

On the other hand, according to the structure shown in FIG. 14, the temperature sensors S1 to S5 are disposed at the center of the respective regions 132*a* to 132*e* without being in contact with the heaters 32; hence, they can measure the temperatures of the supporting tube 36 corresponding to the regions 132*a* to 132*e* correctly, by which a temperature control having a higher precision is made possible.

The ratio of photosensitive silver halides employed in a thermally developable material to organic silver salts may typically be in the range of 0.75 to 25 mole percent, and is preferably in the range of 2 to 20 mole percent.

Such silver halides include all types of photosensitive silver halides such as silver bromide, silver iodide, silver bromoiodide, silver chlorobromide, silver chlorobromide, and the like, and said silver halides are not limited to these. Further, said silver halides may posses any of several forms such as a cubic form, an orthorhombic form, a planar from, a tetrahedron, and the like, as long as they are photosensitive.

Organic silver salts include all organic materials which comprise silver ion reducing sources. Silver salts of organic acids, especially long chain fatty acids (having from 10 to 30 carbon atoms and preferably from 15 to 28 carbon atoms) are preferred. Organic or inorganic silver complexes are preferred which are definitely stable with between 4.0 and 10.0 of total ligands, and the weight ratio of said complexes is preferably between about 5 and about 30 percent of the image forming layer.

Such organic silver salts, which may be employed in the present thermally developable material, are relatively stable against light, and form silver images when heated to 80° C. and higher in the presence of an exposed light catalyst (for instance, photographic silver halides and the like) as well as reducing agents.

Preferred organic silver salts include silver salts of organic compounds having a carboxyl group(s). Preferred examples of silver salts of aliphatic carboxylic acids include silver behenate, silver stearate, and the like. Silver salts bonding to a halogen atom or a hydroxyl group in aliphatic carboxylic acids may effectively be employed. Silver salts of compounds having a mercapto or thione group and derivatives thereof may also be employed. Further, silver salts with imino group containing compounds may further be employed.

Employed as reducing agents for organic silver salts may be any compounds which can reduce silver ions to silver, and organic materials are preferred. Conventional photographic developing agents such as phenidone, hydroquinone, and catechol are useful. Of these, phenol reducing agents are preferred. The reducing agents should be present in an amount of 1 to 10 weight percent of the image forming layer. In a multilayer configuration, when the reducing agents are incorporated into layers other than the emulsion layer, the content ratio is preferably between about 2 and about 15 weight percent, which is slightly greater than the former.

Suitable binders for the thermally developable material of the present invention are either transparent or translucent, and generally colorless. They are film forming media such as natural polymers, synthetic polymers and copolymers, and the like. Examples include gelatin, gum arabic, poly(vinyl alcohol), hydroxyethyl cellulose, cellulose acetate, cellulose acetate butyrate, poly(vinylpyrrolidone), casein, starch, poly (acrylic acid), poly(methyl methacrylic acid), poly(vinyl chloride), poly(methacrylic acid), copoly(styrene-maleic anhydride), copoly(styrene-acrylonitrile), copoly(styrene-butadiene), poly(vinyl acetals), polyurethanes, phenoxy resins, poly(vinylidene chlorides), polyepoxides; polycarbonates, poly(vinyl acetate), cellulose esters, and polyamides. They may be hydrophilic or hydrophobic. In the present invention, however, hydrophobic transparent binders are preferably employed since they tend to decrease fogging after thermal development. Listed as preferred binders are poly(vinyl butyral), cellulose acetate, cellulose acetate butyrate, polyester, polycarbonate, poly(acrylic acid), and polyurethane. Of these, poly(vinyl butyral), cellulose acetate, cellulose acetate butyrate, and polyester are most preferably employed.

Further, in order to protect the surface of photosensitive materials and minimize scratching, a non-photosensitive layer may be provided on the external surface of the photosensitive layer. The binders employed in such a non-sensitive layer may be the same as those employed in the photosensitive layer or be different from them.

In the present invention, in order to increase the rate of thermal development, the amount of binders is preferably between 1.5 and 10 g/m$^2$, and is more preferably between 1.7 and 8 g/m$^2$. When the amount is below 1.5 g/m$^2$, the density of unexposed parts markedly increases, to be on occasion not commercially viable.

In the present invention, matting agents are preferably incorporated into the photosensitive layer. In order to minimize the abrasion of images after thermal development, said matting agents are provided on the surface of a photosensitive material. Such matting agents are preferably incorporated in an amount of 0.5 to 30 percent by weight of the total binders in the non-photosensitive layer. Further, when non-sensitive layers are provided on the reverse side of the photosensitive layer crossing the support, the matting agents are preferably incorporated into at least one of the non-photosensitive layers. Furthermore, in order to improve the slipping properties of the photosensitive material as well as to resist fingerprints, said matting agents are preferably incorporated into the surface of said photosensitive material in an amount of 0.5 to 40 percent by weight of all binders in the layers on the opposite side of the photosensitive layer.

The materials of matting agents employed in the present invention may be either organic or inorganic. For instance, employed as inorganic materials may be silica, glass powder, alkali earth metals or cadmium, carbonates of metals such as zinc and the like, and the like; while employed as organic materials may be organic matting agents such as starch, starch derivatives, poly(vinyl alcohol), polystyrene, polymethacrylate, polyacrylonitrile, or polycarbonate.

The shape of matting agents may be either definite or indefinite. However, the shape is preferably definite and a spherical shape is preferably employed. The size of the matting agent is expressed by the diameter of the sphere having the same volume as said matting agent. In the present invention, the particle diameter of the matting agent refers to said diameter of a sphere having the same volume as said matting agent.

The average particle diameter of matting agents employed in the present invention is preferably between 5 and 10 $\mu$m, and is more preferably between 1.0 and 8.0 $\mu$m. Further, the variation coefficient of the size distribution of the matting agent is preferably no more than 50 percent, is more preferably no more than 40 percent, and is most preferably no more than 30 percent.

Herein, the variation coefficient of the particle size distribution is a value represented by the formula described below.

(Standard deviation of particle diameter)/(average of particle diameter)×100

The matting agents according to the present invention may be incorporated optionally into constituted layers. However, in order to accomplish the objectives of the present invention, they are preferably incorporated into layers other than the photosensitive layer, and are more preferably incorporated into the outermost layer, in reference to the support.

The addition methods of the matting agents according to the present invention may be employed in which a coating composition into which a matting agent is dispersed in advance is coated or after coating a coating composition, a matting agent is sprayed before completion of drying. When a plurality of types of matting agents are added, both methods may be employed in combination.

The thermally developable photosensitive material of the present invention comprises at least one photosensitive layer. The photosensitive layer may only be formed on a support, but at least one non-photosensitive layer is preferably formed. In order to control the amount or wavelength of light, which transmits the photosensitive layer, a filter dye layer on the photosensitive layer side and/or an antihalation dye layer or a so-called backing layer on the reverse side, may be formed. Alternatively, dyes or pigments may be incorporated into the photosensitive layer. Any dyes may be employed as long as they exhibit the specified absorption in the desired wavelength region.

Further, these non-sensitive layers preferably comprise the aforementioned binders as well as matting agents, and in addition, may comprise slipping agents such as polysiloxane compounds, waxes, and liquid paraffin.

The photosensitive layers may be comprised of a plurality of layers, and in order to control the gradation, the photosensitive layer may be comprised of a high sensitive layer/a low sensitive layer or a low sensitive layer/a high sensitive layer configuration.

The thermally developable photosensitive material of the present invention is subjected to thermal development to form photographic images. Thus the thermally developable photosensitive material is preferred which comprises photosensitive silver halides, reducing agents, and as desired, toning agents (organic), which control silver tone, which are generally dispersed into a binder matrix. The thermally developable photosensitive material of the present invention is stable at normal temperatures. However when, after exposure, heated at a relatively high temperature (for example, 80 to 140° C.), it is developed. By heating it, silver is formed through oxidation-reduction reaction between the organic silver salt (which works as an oxidizing agent) and the reducing agent. Said oxidation-reduction reaction is promoted by the catalytic action of a latent image formed in silver halide by exposure. Silver formed through reaction of the organic silver salt in the exposed region provides a black image which is in contrast to the unexposed region. Thus images are formed. Said reaction proceeds without the supply of water, and the like from the exterior.

Suitable toning agents employed in the present invention are disclosed in Research Disclosure 17029, and include the following compounds: imides (for example, phthalimide); cyclic imides; pyralzoline-5-ones and quizolinones (for example, fuchsineimide, 3-phenyl-2-pyrazoline-5-one, 1-phenylurazol, quinazoline, and 2,4-thiazolinedione); naphthalimides (for example, N-hydroxy-1,8-naphthalimide); cobalt complexes (for example, cobalt hexaaminetrifluoro acetate), mercaptans (for example, 3-mercapto-1,2,4-triazole; N-(aminomethyl) aryldicarboxyimides (for example, N-(dimethlaminomethyl)phthalimide); blocked pyrazoles, isothiuronium derivatives and combinations with a certain type of light-bleaching agent (for example, a combination of N,N'-hexamethylene(1-carbamoyl-3,5-dimethylpyrazole), 1,8-(3,6-dioxaoctane)bis(isothiuroniumtrifluoro acetate), and 2-(tribromomethylsulfonyl)benzothiazole); merocyanine dyes (for example, 3-ethyl-5-((3-ethyl-2-benzothiazolynidene(benzothiazolinidene))-1-methylethinilidene)-2-thio-2,4-oxazolidinedione); complexes of phthalazinone and derivates thereof, or metal complexes of these derivatives (for example, 4-(1-naphthyl) phthalazinone, 6-chlorophthalazinone, 5,7-dimethyloxyphthalazine, and 2,3-dihydro-1,4-phthalazinone); combinations of phthalazinone with derivatives of sulfinic acid (for example, 6-chlorophthalazinone+sodium benzenesulfinate or 8-methylphthalzinone+sodium p-trisulfonate); combinations of phthalazine+phthalic acid; combinations of phthalazine (including phthalazine addition products) with at least one compound selected from maleic anhydride and phthalic acid, 2,3-naphthalenedicarboxylic acid or derivatives of 4-nitrophthalic acid and anhydrides thereof (for example, phthalic acid, 4-methylphthalic acid, 4-nitrophthalic acid, and tetrachlorophthalic anhydride); quinazolidiones, benzoxazine, narutoxazine derivatives; benzoxazine-2,4-diones (for example, 1,3-benzoxazine-2,4-dione); pyrimidines and asymmetrical triazines (for example, 2,4-dihydroxypyrimidine), and tetraazapentalene derivatives (for example, 3,6-dimercapto-1,4-diphenyl-1H, 4H-2,3a,5,6a-tetraazapentelene). Of these, the preferred toning agents are phthalozone or phthalazine.

In the present invention, mercapto compounds, disulfide compounds, and thione compounds may be incorporated in order to retard or promote, namely control development, to enhance spectral sensitization efficiency, to improve stability before or after development, and the like.

When mercapto compounds are employed in the present invention, the structure is not limited. However, those represented by Ar—SM or Ar—S—S—Ar are preferred:

Wherein M represents a hydrogen atom or an alkali metal atom, and Ar represents an aromatic ring or a condensed aromatic ring, comprising at least one of a nitrogen atom, a sulfur atom, an oxygen atom, a selenium atom or a tellurium atom. Preferred heterocyclic aromatic rings include benzimidazole, naphthoimidazole, benzothiazole, naphthothiazole, benzoxazole, naphthoxazole, benzoselenazole, benzotetrurazole, imidazole, oxazole, pyrazole, triazole, thiadiazole, tetrazole, triazine, pyrimidine, pyridazine, pyrazine, purine, quinoline or quinazolinone. Said heterocyclic aromatic ring may comprise those selected from a group of substituents composed of, for example, halogens (for instance, Br and Cl), hydroxyl, amino, carboxyl, alkyl (for example, having at least one carbon atom, and preferably 1 to 4 carbon atoms) and alkoxy (for example, having at least one carbon atom, and preferably from 1 to 4 carbon atoms). Listed as mercapto-substituted heterocyclic aromatic compounds are 2-mercaptobenzimidazole, 2-mercaptobenzoxazole, 2-mercaptobenzothiazole, 2-mercapto-5-methylbenzothiazole, 3-mercapto-1,2,4-triazole, 2-mercaptoquinoline, 8-mercaptopurine, 2,3,5,6-tetrachloro-4-pyridinethiol, 4-hydroxy-2-mercaptopyrimidine, 2-mercapto-4-phenyloxazole, and the like. However, the present invention is not limited to these compounds.

Antifoggants may also be incorporated into the thermally developable material of the present invention, however mercury compounds are not preferred environmentally as effective antifoggants. Due to that fact, mercury-free antifoggants have been investigated from the earliest times. Particularly preferred mercury-free antifoggants are those disclosed in U.S. Pat. Nos. 3,874,946 and 4,756,999, which are heterocyclic compounds having at least one substituent, represented by —C(X1)(X2)(X3), wherein X1 and X2 each represents halogen, and X3 represents hydrogen or halogen. Listed as examples of preferred antifoggants are compounds described in paragraphs [0030] through [0036] in Japanese Patent Publication Open to Public Inspection No. 9-288328. Listed as other examples of preferred antifoggants are compounds described in paragraphs [0062] and [0063] in Japanese Patent Publication Open to Public Inspection No. 9-90550.

Sensitizing dyes may be employed in the thermally developable material of the present invention. Regarding useful sensitizing dyes employed in the present invention, it is possible to advantageously select sensitizing dyes having spectral sensitivity suitable for spectral characteristics of various scanner light sources. For example, compounds described in Japanese Patent Publication Open to Public Inspection Nos. 9-34078, 9-54409 and 9-80679 are preferably employed.

Various additives may be added to any of these photosensitive layers, non-photosensitive layers, and other layers. For example, surface active agents, antioxidants, stabilizers, plasticizers, UV absorbers, coating aids, and the like may be employed in the thermally developable material of the present invention. Compounds described in Research Disclosure 17029 (pages 9 to 15, June 1978) may be preferably employed as said additives as well as the aforementioned other additives.

In order to minimize deformation after development, supports employed in the present invention are preferably comprised of plastic film (for example, poly(ethylene terephthalate) (PET), polycarbonate, polyimide, nylon, cellulose triacetate, polylethylene naphthalate). The thickness of such supports is commonly between about 50 and about 300 $\mu$m, and is preferably between 70 and 180 $\mu$m. Further it is possible to use thermally treated plastic supports. Listed as acceptable plastics are those described above. The thermal treatment of supports as described herein means that after casting these supports, said supports are heated at a relatively high temperature but lower than the melting point and at least 30° C. higher than the glass transition point of said supports, preferably at least 35° C. higher, and more preferably at least 40° C. higher than the same.

Employed as the film casting method and the subbing production method related to the present invention may be any of the several methods known in the art. However, methods described in paragraphs [0030] through [0070] of Japanese Patent Publication Open to Public Inspection No. 9-50094 are preferably employed.

In the present invention, for the enhancement of charging properties, electrically conductive compounds such as metal oxide and/or electrically conductive polymers may be incorporated into the formed layers. These may be incorporated into any of several layers. However, they are preferably incorporated into a subbing layer, a backing layer, a layer between the photosensitive layer and the subbing layer, and the like. In the present invention, the electrically conductive compounds, described in columns 14 through 20 of U.S. Pat. No. 5,244,773, are preferably employed.

EXAMPLES

Each of the apparatus in the first and second examples of the embodiments was subjected to apparatus calibration and adjustment of its temperature control pattern. The following experiments were then carried out. Said experiments were carried out for each of films F-1 and F-2 shown below. Ten sheets of film F having a size of 10 inches wide×14 inches long in the conveying direction were subjected to continual thermal development. Thereafter, film F having a size of a 17 inches wide×14 inches long in the conveying direction, which was subjected to exposure of a test pattern for detecting uneven density employing exposure section 120, was thermally developed, and any resultant uneven density in the width direction was observed. Further, in the aforementioned embodiment, width A corresponds to 10 inches while width B corresponds to 17 inches.

The experimental results indicated that uneven density, which resulted in problems for commercial viability, was not found in every example. Further, the density of film F, having a size of 17 inches wide×14 inches long in the conveying direction, was measured by a densitometer, and the maximum density difference in the measured film was obtained. It was found that the maximum density difference of each film was 0.10.

In the following, film F, which is preferably employed in the aforementioned embodiment employed in said experiments, will now be described.

1. Film F-1

A silver halide-silver behenate dry soap was prepared employing the method described in U.S. Pat. No. 3,839,049. The content ratio of said silver halide was 9 mole percent of the total silver, while that of silver behenate was 91 mole percent of the total silver. Said silver halide was a 0.055 $\mu$m silver bromoiodide emulsion comprising 2 percent iodide.

A thermally developable emulsion was uniformly mixed with 455 g of the aforementioned silver halide-silver behenate dry soap, 27 g of toluene, 1918 g of 2-butanone, and poly(vinyl butyral) (B-79, manufactured by Monsanto). The aforementioned uniformly mixed thermally developable emulsion (698 g) and 60 g of 2-butanone were cooled to 12.8° C. while being stirred. Pyridinium hydrobromide perbromide (0.92 g) was then added and the resulting mixture was then stirred for additional 2 hours.

Added to the resulting mixture were 3.25 milliliters of a calcium bromide solution (consisting of $CaBr_2$ (1 g) and 10 milliliters of methanol), and subsequently stirred for 30 minutes. Further, poly(vinyl butyral) (158 g of B-79, manufactured by Monsanto) was added and stirred for 20 minutes. Then, after heating the resulting mixture to 21.1° C., the components described below were added while string over 15 minutes.

| | |
|---|---|
| 2-(Tribromomethylsulfone)quinoline | 3.42 g |
| 1.1-Bis(2-hydroxy-3,5-dimethylphenyl)-3,5,5-trimethylhexane | 28.1 g |
| Solution comprising 0.545 g of 5-methylmercaptobenzimidazole | 41.1 g |
| 2-(4-Chlorobenzoyl)benzoic acid | 6.12 g |
| S-1 (sensitizing dye) | 0.104 g |
| Methanol | 34.3 g |
| Isocyanate (Desumoda N3300, manufactured by Mobay) | 2.14 g |
| Tetrachlorophthalic anhydride | 0.97 g |
| Phthalazine | 2.88 g |

Further, Dye S-1 has the following structure.

S-1

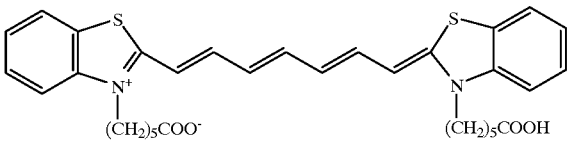

An active top coat solution was prepared using the following components:

| | |
|---|---|
| 2-Butanone | 80.0 g |
| Methanol | 10.7 g |
| Cellulose acetate butyrate (CAB-171-155, manufactured by Eastman Chemicals) | 8.0 g |
| 4-Methylphthalic acid | 0.52 g |
| MRA-1, motoru reducing agent,tertiary polymer of N-ethylperfluoroctanesulfonylamidoethyl methacrylate/hydroxyethyl methacrylate/acrylic acid having a weight ratio of 70:20:10 | 0.80 g |

The resulting thermally developable emulsion and top coat were simultaneously applied to a 0.18 mm blue-tinted polyester film base. A knife coater was arranged in such a manner that two bars and knives for simultaneous coating were installed to be at a distance of 15.2 cm between them. A multilayer coating was carried out in such a manner that for the silver trip layer as well as the top coat, the silver emulsion was poured onto the film prior to the rear knife, and the top coat was poured onto the film prior to the front bar.

The resulting film was then transported forward so that both layers were simultaneously coated. The coating was obtained by carrying out employing one multilayer coating method. The coated polyester base was dried at 70.4° C. for 4 minutes. Said knives were adjusted so as to obtain a dried coated layer weight of 23 g/m$^2$ for the silver layer and the same of 2.4 g/m$^2$ for the top coat.

2. Film F-2

This film was one in which a photosensitive layer and a protective surface layer were provided on a photographic support in said order, while on the other surface, a backing layer was provided. Said film was prepared employing the method described below.

(Preparation of the Photographic Support)

Both surfaces of a 175 $\mu$m thick blue-tinted PET film at a density of 0.170 (measured by a Densitometer PDA-65, manufactured by Konica Corp.) was subjected to corona discharge treatment of 8 w/m$^2$ per minute.

(Preparation of Photosensitive Silver Halide Emulsion A)

Dissolved in 900 ml of water were 7.5 g of ossein gelatin having an average molecular weight of 100,000 and 10 mg of potassium bromide. After adjusting the temperature to 35° C. and the pH to 3.0, 370 ml of an aqueous solution containing 74 g of silver nitrate and an aqueous solution containing potassium bromide and potassium iodide in a mole ratio of 98/2, having the same mole of silver nitrate in total, and $1\times10^{-4}$ mole of iridium chloride per mole of silver were added over 10 minutes, employing a controlled double-jet method, while maintaining the pAg at 7.7. Thereafter, 0.3 g of 4-hydroxy-6-methyl-1,3,3a,7-tetraazaindene was added and the pH was adjusted to 5 employing NaOH. Thus cubic silver iodobromide grains were obtained which had an average grain size of 0.06 $\mu$m, a variation coefficient of grain size of 12 percent, and a [100] plain ratio of 87 percent. The resulting emulsion was flocculated employing a gelatin flocculant, and was subjected to desalting treatment. Added to the resulting emulsion was 0.1 g of phenoxyethanol, and the pH and the pAg were adjusted to 5.9 and 7.5 respectively, to obtain Photosensitive Silver Halide Emulsion A.

(Preparation of Organic Silver Salt Powder A)

Dissolved in 4720 ml of pure water were 111.4 g of behenic acid, 83.8 g of arachidic acid, and 54.9 g of stearic acid. Subsequently, while stirring the resulting mixture at a high speed, 540.2 ml of 1.5M aqueous sodium hydroxide solution were added, and then 6.9 ml of concentrated nitric acid were added. Thereafter, the resulting mixture was cooled to 55° C. to obtain an organic acid sodium salt solution. While maintaining the temperature of said organic acid sodium salt solution at 55° C., the aforementioned silver halide emulsion (comprising silver of 0.038 mole) and 450 ml of pure water were added and stirred for 5 minutes. Subsequently, 760.6 ml of 1M of silver nitrate solution were added over 2 minutes, further stirred for another 20 minutes, and water-soluble salts were removed by filtration. Thereafter, washing was carried out employing deionized water so that the electrical conductivity of the waste wash water became 2 $\mu$S/cm, and centrifugal hydroextraction was carried out. Drying was then carried out at 37° C. employing a heated airflow, and an organic silver salt powder was thus obtained.

(Preparation of Photosensitive Emulsion Dispersion 1)

Dissolved in 1457 g of methyl ethyl ketone were 14.57 g of poly(vinyl butyral) powder (Butvar B-79, Monsanto Co.), and 500 g of organic silver salt powder were gradually added to the resulting mixture while stirring, employing a dissolver type homogenizer and well mixed. Thereafter, dispersion was carried out at a circumferential speed of 13 m and a retention time of 0.5 minute in a mill, employing a media type homogenizer (manufactured by Gettzmann) filled to 80 percent capacity with 1 mm Zr beads (manufactured by Toray). Thus, Photosensitive Emulsion Dispersion 1 was prepared.

<Preparation of Infrared Sensitizing Dye Solution>

In a light shielded place, dissolved in 73.4 ml of methanol were 350 mg of Infrared Sensitizing Dye 1, 13.96 g of 2-chlorobenzoic acid, and 2.14 g of 5-methyl-2-mercaptobenzimidazole.

(Preparation of the Photosensitive Layer Coating Composition)

The aforementioned Photosensitive Emulsion B (500 g) and 100 g of MEK were heated to 21° C. while stirring. Pyridinium hydrobromide perbromide (PHP, 0.45 g) was added and stirred for one hour. Further, calcium bromide (3.25 ml of 10 percent methanol solution) was added and stirred for 30 minutes.

Subsequently, a mixed solution (at a mixing ratio of 1:250:20, 7 ml of 0.1 percent methanol solution in terms of the sensitizing dye) of Sensitizing Dye-1, 4-chloro-2-benzoylbenzoic acid, and a supersensitizer (5-methyl-2-mercaptobenzimidazole) was added and stirred for one hour. The resulting mixture was then cooled to 13° C. and further stirred for 30 minutes.

While maintaining a temperature at 13° C., 43 g of poly(vinyl butyral) were added, well dissolved, and then the following additives were added:

| | |
|---|---|
| Developing agent (1,1-bis(2-hydroxy-3,5-dimethylphenyl)-2-methylpropane | 15 g |
| Desumodyu N3300 (aliphatic isocyanate, Mobay Co.) | 1.10 g |
| Phthalazine | 1.5 g |
| Tetrachlorophthalic acid | 0.5 g |
| 4-Methylphthalic acid | 0.5 g |

After preparing the photosensitive layer coating composition, said composition was heated at 13° C. and was kept standing for the time shown in Table 1.

<Back Surface Coating>

(Preparation of the Back Surface Coating Composition)

Added to and dissolved in 830 g of methyl ethyl ketone while stirring were 84.2 g of cellulose acetate butyrate (CAB 381-20, Eastman Chemical Co.) and 4.5 g of a polyester resin (Vitel PE2200B, Bostic Co.). Added to the resulting solution was 0.30 g of Infrared Dye-1 and further were 4.5 g of an F-based surface active agent (Surfron KH40, Asahi Glass Co.) and 2.3 g of an F-based surface active agent (Megafag F120K, Dainippon Ink Co.) dissolved in 43.2 g of methanol. The resulting mixture was well stirred until the added compounds were fully dissolved. Finally, added and stirred were 75 g of silica (Siloid 64X6000, W. R. Grace Co.) which was dispersed into methyl ethyl ketone at a concentration of 1 percent by weight, employing a dissolver type homogenizer. A back surface coating composition was thus prepared.

(Back Surface Coating)

The back surface coating composition prepared as described above was coated and dried employing an extrusion coater to obtain a dried layer thickness of 3.5$\mu$. Drying was carried out for 5 minutes employing dry air at a temperature of 100° C. and a dew point of 10° C.

<Protective Surface Layer>

(Preparation of Dispersion)

Dissolved in 42.5 g of methyl ethyl ketone were 7.5 g of cellulose acetate butyrate (CAB 171-15, Eastman Chemical Co.). Added to the resulting mixture were 5 g of calcium carbonate (Super-Pflex 200, Speciality Minerals Co.), and dispersed at 8000 rpm for 30 minutes employing a dissolver type homogenizer, preparing a calcium carbonate dispersion.

(Preparation of the Protective Surface Layer Coating Composition)

Added to and dissolved in 865 g of methyl ethyl ketone were, while stirring, 96 g of cellulose acetate butyrate (CAB 171-15, Eastman Chemical Co.) and 4.5 g of poly(methyl methacrylic acid) (Paraloid A-21, Rohm and Haas Co.). Added to and dissolved in the resulting solution were 1.5 g of vinyl sulfone compound HD-1, 1.0 g of benztriazole, and 1.0 g of an F-based surface active agent (Surfron KH40, Asahi Glass Co.). Finally 30 g of calcium carbonate dispersion were added and well stirred to prepare a protective surface layer coating composition.

<Coating of the Photosensitive Layer Surface Side>

The aforementioned photosensitive layer coating composition and protective surface layer coating composition were subjected to simultaneous multilayer coating employing an extrusion coater. The coating was carried out at a speed of 20 m per minutes to obtain a coated silver amount for said photosensitive layer of 2.4 g/m$^2$ and a dried layer thickness for said protective surface layer of 2.5$\mu$. Thereafter, drying was carried out for 10 minutes employing drying air at a temperature of 75° C. and a dew point of 10° C.

By the present invention, the occurrence of density irregularities on the thermally developable material can be avoided.

What is claimed is:

1. A thermally developing apparatus, comprising:

a heating member to heat a thermally developable material;

supplying means for supplying the thermally developable material in a predetermined supplying direction to the heating member;

the heating member comprising plural regions aligned in a direction substantially perpendicular to the supplying direction of the thermally developable material by the supplying means;

plural heaters each provided separately to one of the plural regions and to heat a corresponding one of the plural regions of the heating member; and a controller to control heat generation of the plural heaters, the controller controlling at least one of the plural heaters in accordance with a size of the thermally developable material which is a dimension substantially perpendicular to the supplying direction, so that a temperature variation on the heating member in the direction substantially perpendicular to the supply direction is kept within a range of 2.0° C.

2. The thermally developing apparatus of claim 1, wherein the controller controls at least one of the plural heaters in such a manner that a control target for at least one of the plural regions is made different from a control target for the other regions in accordance with the size of the thermally developable material.

3. The thermally developing apparatus of claim 1, further comprising:

a size sensor to detect the dimension of the thermally developable material substantially perpendicular to the supplying direction as the size of the thermally developable material, wherein the controller controls heat generation of at least one of the plural heaters in accordance with a detection result of the size sensor.

4. The thermally developing apparatus of claim 1, wherein a control target for at least one of the plural heaters at the timing that the supplying means supplies the thermally developable material is made different from a control target for the heater at the other timing.

5. The thermally developing apparatus of claim 4, wherein the controller controls heat generation of the plural heaters in such a manner that a control target for at least one of heaters provided to regions to which the thermally developable material is not supplied when the supplying means supplies the thermally developable material to the heating member is made lower than a control target for the heater when the supplying means does not supply the thermally developable material to the heating member.

6. The thermally developing apparatus of claim 5, wherein the controller controls heat generation of the plural heaters in such a manner that a control target for at least one of heaters provided to regions to which the thermally developable material is not supplied when the supplying means supplies the thermally developable material to the heating member is made different in accordance with the size of the thermally developable material.

7. The thermally developing apparatus of claim 4, wherein the supplying means supplies plural types of thermally developable materials different in a dimension substantially perpendicular to the supplying direction, a control target for at least one of heaters provided to regions to which all of the plural types of thermally developable materials are supplied is made higher at the timing to supply a thermally developable material than a control target for the heater at the other timing.

8. The thermally developing apparatus of claim 7, wherein a control target for at least one of heaters provided to regions to which all of the plural types of thermally developable materials are supplied is made different in accordance with the size of the thermally developable material.

9. The thermally developing apparatus of claim 4, wherein a range between a control target at the timing to supply the thermally developable material and a control target at the other timing is smoothed by a ramp processing.

10. The thermally developing apparatus of claim 4, wherein the heating member comprises a metallic supporting member and an elastic layer located at a heating surface side of the metallic supporting member, and the heater is a plane heater provided in close contact with a surface at a side opposite to the heating surface side of metallic supporting member.

11. The thermally developing apparatus of claim 1, wherein the thermally developing apparatus is adapted to develop plural types of thermally developable materials different in a dimension substantially perpendicular to the supplying direction, and wherein the plural regions to which a thermally developable material having the maximum size among the plural types of thermally developable materials is supplied is divided into three regions of a central region and side regions in the direction substantially perpendicular to the supplying direction and the thermally developing apparatus further comprises temperature sensors provided at the side regions respectively so as to be in close contact with the heating member so that the temperature sensors detect the temperature of the heating member.

12. The thermally developing apparatus of claim 11, wherein each of the side regions of the heating member is provided with a groove and each of the temperature sensors is provided in the groove.

13. The thermally developing apparatus of claim 12, wherein the grooves are located both ends of the heating member in the direction substantially perpendicular to the supplying direction.

14. The thermally developing apparatus of claim 11, wherein the controller conducts temperature control by using a value corresponding to a time integral value of the temperature detected by the temperature detecting means.

15. The thermally developing apparatus of claim 11, wherein the controller conducts temperature control by using a value corresponding to a time differential value of the temperature detected by the temperature detecting means.

16. The thermally developing apparatus of claim 1, wherein the plural heaters are operated ON-mode or OFF-mode and the controller controls the heater by a duty ratio of the ON-mode to the OFF-mode.

17. The thermally developing apparatus of claim 1, wherein the thermally developing means comprises a thermally developing section to thermally develop the thermally developable material, the thermally developing section has an inner section covered with a heat insulating member and the heater and the heating member are provided in the inner section.

18. The thermally developing apparatus of claim 17, wherein the controller controls heat generation of the plural heaters in such a manner that a ratio of a sum of amounts of heat which the plural heaters give a single sheet of a thermally developable material when the single sheet of a thermally developable material is thermally developed to a sum of the maximum amounts of the plural heaters when the single sheet of a thermally developable material is thermally developed is 0.04 to 0.75.

19. The thermally developing apparatus of claim 1, wherein the heating member is a rotating member which heats the thermally developable material while rotating on a condition that the thermally developable material is in close contact with a outer circumferential surface of the rotating member, the rotating member is divided so as to have the plural regions aligned in an axial direction thereof and each of the plural regions is provided with one of the plural heaters.

20. The thermally developing apparatus of claim 1, further comprising:

a rotatable roller urged onto the heating member.

21. The thermally developing apparatus of claim 1, wherein an elastic layer having a thickness of 0.1 mm or more is provided on a surface of the heating member.

22. The thermally developing apparatus of claim 21, wherein a ratio of a thermal conductivity of the elastic layer to the thickness of the elastic layer is 0.15 (W/m/°K/mm) or more, and the heating member comprises a metallic supporting member to support directly or indirectly the elastic member.

23. The thermally developing apparatus of claim 21, wherein the elastic layer has the thickness of 2 mm or less and the thermal conductivity of 0.3 W/m/°K or more.

24. A thermally developing apparatus, comprising:

a heating member to heat a thermally developable material;

supplying means for supplying the thermally developable material in a predetermined supplying direction to the heating member;

the heating member comprising plural regions aligned in a direction substantially perpendicular to the supplying direction of the thermally developable material by the supplying means;

plural heaters each provided separately to one of the plural regions and to heat a corresponding one of the plural regions of the heating member; and a controller to control heat generation of the plural heaters, the controller controls the plural heaters in such a manner that a control target for a heater at the time that the supplying means supplies the thermally developable material to the heating member is made different from that for a heater at the other time in accordance with a size of the thermally developable material which is a dimension substantially perpendicular to the supplying direction, so that a temperature variation on the heating member in the direction substantially perpendicular to the supply direction is kept within a range of 2.0° C.

25. The thermally developing apparatus of claim 24, further comprising:

a size sensor to detect the dimension of the thermally developable material substantially perpendicular to the supplying direction as the size of the thermally developable material, wherein the controller controls heat generation of at least one of the plural heaters in accordance with a detection result of the size sensor.

26. A thermally developing apparatus, comprising:

a heating member to heat a thermally developable material, supplying means for supplying the thermally developable material in a predetermined supplying direction to the heating member;

the heating member comprising plural regions aligned in a direction substantially perpendicular to the supplying direction of the thermally developable material by the supplying means;

plural heaters each provided separately to one of the plural regions and to heat a corresponding one of the plural regions of the heating member, and a controller to control heat generation of the plural heaters, the controller controlling at least one of the plural heaters in accordance with a size of the thermally developable material which is a dimension substantially perpendicular to the supplying direction, wherein the controller controls heat generation of the plural heaters in such a manner that a control target for at least one of heaters provided to regions to which the thermally developable material is not supplied when the supplying means supplies the thermally developable material to the heating member is made lower than a control target for the heater when the supplying means does not supply the thermally developable material to the heating member.

27. The thermally developing apparatus of claim 26, wherein the controller controls heat generation of the plural heaters in such a manner that a control target for at least one of heaters provided to regions to which the thermally developable material is not supplied when the supplying means supplies the thermally developable material to the heating member is made different in accordance with the size of the thermally developable material.

28. A thermally developing apparatus, comprising:

a heating member to heat a thermally developable material;

supplying means for supplying the thermally developable material in a predetermined supplying direction to the heating member;

the heating member comprising plural regions aligned in a direction substantially perpendicular to the supplying direction of the thermally developable material by the supplying means;

plural heaters each provided separately to one of the plural regions and to heat a corresponding one of the plural regions of the heating member; and a controller to control heat generation of the plural heaters, the controller controlling at least one of the plural heaters in accordance with a size of the thermally developable material which is dimension substantially perpendicular to the supplying direction, wherein when the supplying means supplies plural types of thermally developable materials different in a dimension substantially perpendicular to the supplying direction, a control target for at least one of heaters provided to regions to which all of the plural types of thermally developable materials are supplied is made higher at the timing to supply a thermally developable material than a control target for the heater at the other timing, and wherein a control target for the heater provided to the regions to which all of the plural types of thermally developable materials are supplied is made different in accordance with the size of the thermally developable material.

29. A thermally developing apparatus, comprising:

a heating member to heat a thermally developable material;

supplying means for supplying the thermally developable material in a predetermined supplying direction to the heating member;

the heating member comprising plural regions aligned in a direction substantially perpendicular to the supplying direction of the thermally developable material by the supplying means;

plural heaters each provided separately to one of the plural regions and to heat a corresponding one of the plural regions of the heating member; and a controller to control heat generation of the plural heaters, the controller controlling at least one of the plural heaters in accordance with a size of the thermally developable material which is a dimension substantially perpendicular to the supplying direction, wherein the thermally developing apparatus is adapted to develop plural types of thermally developable materials different in a dimension substantially perpendicular to the supplying direction, and wherein the plural regions to which a thermally developable material having the maximum size among the plural types of thermally developable materials is supplied is divided into three regions of a central region and side regions in the direction substantially perpendicular to the supplying direction and the thermally developing apparatus further comprises temperature sensors provided at the side regions respectively so as to be in close contact with the heating member so that the temperature sensors detect the temperature of the heating member, and wherein each of the side regions of the heating member is provided with a groove and each of the temperature sensors is provided in the groove.

30. The thermally developing apparatus of claim 29, wherein the grooves are located both ends of the heating member in the direction substantially perpendicular to the supplying direction.

31. The thermally developing apparatus of claim 1, wherein the temperature variation on the heating member is kept within a range of 1° C.

32. The thermally developing apparatus of claim 31, wherein the temperature variation on the heating member is kept within a range of 0.5° C.

* * * * *